US005667261A

United States Patent [19]

Weinerman et al.

[11] Patent Number: 5,667,261

[45] Date of Patent: *Sep. 16, 1997

[54] HANDLE OPERATED HEAVY DUTY DRAW LATCH WITH SAFETY CATCH

[75] Inventors: Lee S. Weinerman, Medina; Arthur J. Kuminski, Parma; James L. Hollingsworth, Middleburg Heights, all of Ohio

[73] Assignee: The Eastern Company, Cleveland, Ohio

[ * ] Notice: The term of this patent shall not extend beyond the expiration date of Pat. No. 5,445,422.

[21] Appl. No.: 280,720

[22] Filed: Jul. 26, 1994

Related U.S. Application Data

[63] Continuation-in-part of Ser. No. 65,283, May 21, 1993, abandoned, Ser. No. 8,629, May 21, 1993, abandoned, Ser. No. 278,008, Jul. 20, 1994, Pat. No. 5,445,422, and Ser. No. 26,147, Jul. 20, 1994, Pat. No. Des. 364,082, which is a continuation-in-part of Ser. No. 65,283, and Ser. No. 8,629, said Ser. No. 278,008, is a continuation-in-part of Ser. No. 65,283, and Ser. No. 8,629.

[51] Int. Cl.[6] ..... E05C 5/00

[52] U.S. Cl. ..... 292/247; 292/113

[58] Field of Search ..... 292/113, 247, 292/256.69, DIG. 49

[56] References Cited

U.S. PATENT DOCUMENTS

| | | | |
|---|---|---|---|
| D. 257,218 | 10/1980 | Eriksson | D8/336 |
| D. 333,775 | 3/1993 | Krape | D8/331 |
| D. 343,782 | 2/1994 | Gromotka et al. | D8/331 |
| D. 364,082 | 11/1995 | Weinerman et al. | D8/331 |
| 1,734,282 | 11/1929 | White | 292/250 |
| 2,690,921 | 10/1954 | Braun | 292/113 |
| 3,162,419 | 12/1964 | Blasingame | 292/113 |
| 3,519,298 | 7/1970 | Gley et al. | 292/113 |
| 3,936,082 | 2/1976 | Swanson | 292/113 |
| 4,116,479 | 9/1978 | Poe | 292/113 |

(List continued on next page.)

OTHER PUBLICATIONS

De–Sta–Co Advertising Sheet, Series MASO "Pull Action Clamps," De–Sta–Co Company, Troy, MI 48007 (Date Unknown, But is Prior to May of 1992).

De–Sta–Co Catalog "The World of Clamping," pp. 23–28, 42–44 & 49–51, De–Sta–Co Company, Troy, MI 48007 (Believed to Have Been Published Mar., 1993).

Nielsen Hardware Corp. Catalog (1986) p. 30 Entitled "Adjustable Catch".

*Primary Examiner*—Steven N. Meyers
*Assistant Examiner*—Gary Estrewsky
*Attorney, Agent, or Firm*—David A. Burge

[57] ABSTRACT

A handle operated, heavy duty, toggle type draw latch is mountable on one of two members and is operable to selectively engage and disengage a latch-engageable formation connected to the other of the two members. The latch includes a complexly configured operating handle that is pivotally connected near one end to a mounting base for movement relative to the base between closed and open positions, that provides a hand grip near its opposite end, and that, at locations between its opposite ends pivotally mounts a drawbar for movement between extended and retracted positions, and defines not only a plurality of stops but also a catch-engageable formation. One stop engages the base when the handle is closed. Another stop engages the base when the handle is fully open. Still another stop engages the drawbar when the drawbar is retracted. When the handle is open, the drawbar can be pivoted into and out of extended positions for selectively embracing the latch-engageable formation. If the handle is pivoted to its closed position while the drawbar is extended to embrace the latch-engageable formation, the drawbar exerts force on the latch-engageable formation that tends to draw the two members relatively toward each other. A base-carried safety catch pivots between latched and unlatched positions for receiving and releasably retaining the catch-engageable formation of the handle when the handle is closed.

31 Claims, 6 Drawing Sheets

U.S. PATENT DOCUMENTS

| | | | |
|---|---|---|---|
| 4,181,333 | 1/1980 | Steluna | 292/113 |
| 4,212,606 | 7/1980 | Sachleben | 292/113 |
| 4,243,255 | 1/1981 | Hornak | 292/113 |
| 4,307,906 | 12/1981 | Schenk | 292/247 |
| 4,326,739 | 4/1982 | Schlueter | 292/247 |
| 4,493,133 | 1/1985 | Nilsson | 24/68 |
| 4,530,529 | 7/1985 | Poe et al. | 292/113 |
| 4,531,769 | 7/1985 | Glancy | 292/113 |
| 4,540,206 | 9/1985 | Frame et al. | 292/66 |
| 4,588,216 | 5/1986 | Hinds | 292/113 |
| 4,768,815 | 9/1988 | Harmon | 292/113 |
| 4,890,869 | 1/1990 | Langkamp, Jr. | 292/113 |
| 4,936,239 | 6/1990 | Awalt | 292/DIG. 49 |
| 5,131,246 | 7/1992 | Bonzer | 292/113 |
| 5,165,148 | 11/1992 | Fleigher | 292/113 |
| 5,257,839 | 11/1993 | Nielsen et al. | 292/113 |
| 5,287,602 | 2/1994 | Dykstra | 24/463 |
| 5,445,422 | 8/1995 | Weinerman | 292/247 |

HANDLE OPERATED HEAVY DUTY DRAW LATCH WITH SAFETY CATCH

CROSS-REFERENCE TO RELATED APPLICATIONS

The present application is a continuation-in-part of each of two recently filed applications, namely utility application Ser. No. 08/278,008, (Atty's Docket No. 5-035) filed Jul. 20, 1994 by Lee S. Weinerman and Arthur J. Kuminski now U.S. Pat. No. 5,445,422 entitled HANDLE OPERATED DRAW LATCH WITH SAFETY CATCH, and design application Ser. No. 29/026,147 (Atty's Docket No. 5-036) filed Jul. 20, 1994 by Lee S. Weinerman and Arthur J. Kuminski now U.S. Pat. No. Des. 364,082 entitled HANDLE OPERATED DRAW LATCH ASSEMBLY WITH LOCKABLE SAFETY CATCH, the disclosures of which are incorporated herein by reference.

The present application (and each of the two recently filed co-pending applications that are identified above), also is a continuation-in-part of each of two additional applications, namely utility application Ser. No. 08/065,283 filed May 21, 1993 by Lee S. Weinerman and Arthur J. Kuminski now abandoned entitled HANDLE OPERATED DRAW LATCH WITH SAFETY CATCH, and design application Ser. No. 29/008,629 filed May 21, 1993 by Lee S. Weinerman and Arthur J. Kuminski now abandoned entitled HANDLE OPERATED DRAW LATCH ASSEMBLY WITH LOCKABLE SAFETY CATCH, the disclosures of which are incorporated herein by reference.

Reference also is made to a related design application, the disclosure of which is incorporated herein by reference, entitled HANDLE OPERATED HEAVY DUTY DRAW LATCH ASSEMBLY WITH LOCKABLE SAFETY CATCH, Ser. No. 24/026,361 (Atty's Docket No. 5-056) filed Jul. 26, 1994 (concurrently herewith) by Lee S. Weinerman, Arthur J. Kuminski and James L. Hollingsworth.

BACKGROUND OF THE INVENTION

1. Field of the Invention

The present invention relates generally to a handle operated, heavy duty, toggle type draw latch for connecting two relatively movable members, and for exerting force that tends to draw the two members relatively toward each other, with the latch having components that cooperate to provide an unusually rugged unit. More particularly, the present invention relates to a handle operated toggle latch featuring ruggedly constructed components that cooperatively interact when the latch is "latched" to reinforce each other to enhance the capability of the latch to withstand heavy direct draw force and forces that tend to cause latch components to twist, rack and bend. The latch features a base of novel configuration, and a relatively complexly configured handle that cooperates with the base and with other latch components of provide stops for limiting the ranges of movement that can be executed by relatively movable components, and preferably also includes a lockable safety catch for securely retaining the handle in a closed position until the safety catch is operated to release the handle for movement to an open position.

2. Prior Art

Toggle latches of a variety of types have been proposed for use in releasably joining two relatively movable members. Usually, what is referred to as a "toggle latch" has at least a pair of pivotally interconnected, link-like components that are "toggled" through an "over center" position to effect latching and unlatching movements.

Toggle latches that are operable to releasably join and to draw two relatively movable members toward each other are sometimes referred to as "draw latches." Usually, a toggle-type draw latch includes a latch assembly that can be mounted on a first of two relatively movable members, and has what is referred to as a "drawbar" that can be moved, when the latch is "open," into and out of connection with a latch-engageable formation that is connected to the second of the relatively movable members. When components of the latch are moved latchingly toward a "closed" position, the drawbar serves not only to engage the latch-engageable formation to join the first and second relatively movable members but also to exert force on the latch-engageable formation that tends to move the members relatively toward each other.

While some toggle-type draw latches rely solely on tension force that is applied through over-center connected components to retain latch components in their "closed" positions, proposals have been made to use spring acting safety catches of various forms to releasably retain latch components closed. Some proposed safety catches are mere leaf springs, portions of which are deflectable for movement into and out of latching engagement with relatively movable components—an arrangement that may not be well suited for use in a high-load application where vibration is present. Another safety catch proposal calls for the use of a spring-biased slide carried on one movable component for being received in an aperture defined by another movable component—an arrangement that involves no secure connection of the safety catch to a stationary base member, and that is not lockable to secure the safety catch.

Most prior toggle latch proposals are intended to address relatively light duty applications—applications that require toggle latches to regularly withstand less than a thousand pounds of direct draw force. Previously proposed handle operated, toggle type draw latches have not exhibited a desired degree of ruggedness to withstand use in high load applications, for example in securely retaining large, heavily loaded, interstate and international cargo containers in place during over-the-road transport atop the flat beds of highway vehicles such as semi-trailer trucks. Such applications often require that the latches used to hold cargo containers in place be capable of withstanding not only tons of direct draw force but also correspondingly high transverse force loadings that tend to twist, rack and bend latch components.

3. The Referenced Parent Applications

The two co-pending utility applications that are referenced above disclose handle operated toggle latches that are designed to withstand lighter loads than are capable of being addressed by latches that embody features of the present invention. However, some latch features that are disclosed in the referenced applications are incorporated in latches that embody the preferred practice of the present invention. One such feature is a base-mounted safety catch that engages a handle-carried formation for releasably retaining a latch operating handle in its closed position, and that can be "locked" using a conventional padlock to add a degree of security.

Another feature disclosed in the referenced co-pending utility applications is the use of two elongate, complexly configured stamped metal members (that essentially are left and right "mirror images" of each other) that are rigidly connected to extend in side by side relationship to form an operating handle that is pivotally connected to a base and to a drawbar of a toggle latch. This concept, suitably modified to provide a considerably more rugged handle assembly, finds use in latches that embody the preferred practice of the present invention.

SUMMARY OF THE INVENTION

The present invention addresses the foregoing and other needs and drawbacks of the prior art by providing a novel and improved, handle operated, heavy duty, toggle type draw latch for connecting two relatively movable members and for exerting force thereon that tends to draw the two members relatively toward each other, with the latch featuring ruggedly constructed components that cooperatively interact when the latch is "latched" to reinforce each other to enhance the capability of the latch to withstand heavy direct draw force and such other forces as may tend to cause latch components to twist, rack and bend.

In preferred practice, a handle operated, toggle type draw latch that embodies features of the present invention also utilizes a base-carried spring-biased safety catch of the type that is disclosed in the two above-identified utility applications that is padlockable not only to secure the safety catch but also to physically block opening movements of latch components by effectively locking the operating handle to the base of the latch.

In one preferred form of practice, the present invention provides a toggle type draw latch that is mountable on one of two members and is operable to selectively engage and disengage a latch-engageable formation connected to the other of the two members, with the latch including a complexly configured operating handle 1) that is pivotally connected near one end to a mounting base for movement relative to the base between closed and open positions, 2) that provides a handgrip near its opposite end, 3) that, at one location spaced between its opposite ends, pivotally mounts a drawbar for movement between extended and retracted positions, and that, at other locations spaced along its length 4) defines one stop that engages the base when the handle is fully "closed," 5) defines another stop that engages the base when the handle is fully "open," 6) defines still another stop that engages the drawbar when the drawbar is retracted, and 7) defines a catch-engageable formation that is latchingly engaged by a spring-biased safety catch when the handle is closed.

The handle preferably is formed using a pair of elongate, complexly configured handle components 1) that have configurations that are substantially left and right "mirror images" of each other, 2) that extend substantially congruently, and 3) that are rigidly connected but are held in spaced relationship to provide a handle structure that has a relatively high moment of inertia that is quite effective in resisting deformation and twisting. The elongate members define side-by-side handgrip formations that are perimetrically enclosed by a plastic sleeve that bridges the space between the handgrip formations to provide a grip that features a good "feel." First and second pivot pins extends through sets of aligned holes that are formed through the spaced handle members to pivotally connect the handle to the base and to the drawbar of the latch, respectively. A torsion coil spring is protectively housed in the space that extends between the two handle members, is connected to the handle, and is reeved around and connected to the second pivot pin to bias the drawbar toward its retracted position where the drawbar engages a handle-carried stop that is located adjacent the handgrip.

The base preferably is formed as a welded assembly of two stamped steel components that are arranged to define a base that is substantially symmetrical about an imaginary "center plane." One of the base components is an L-shaped member having a relatively long, relatively flat "mounting leg" that is joined by a substantially right angle bend to a relatively shorter, relatively flat "end leg." The mounting leg extends in a first plane that is substantially perpendicular to the center plane, while the end leg extends in a second plane that is substantially perpendicular to the center plane and to the first plane. Each of these legs have left and right "halves" that are "mirror images" of each other, and that are situated on opposite sides of the center plane.

The other of the base components is a U-shaped member having a pair of identically configured front and rear legs that extend in parallel planes located at equal distances from and on opposite sides of the center plane. The front and rear legs are interconnected and held in spaced relationship by a bottom leg that extends atop the mounting leg of the L-shaped member. The U-shaped member is welded to the L-shaped member by welds that connect the base leg to the mounting leg along regions where the front and rear legs are joined to the base leg by right angle bends, and along edges of the front and rear legs that extend into engagement with the end leg of the L-shaped member. Aligned holes are formed through the spaced front and rear legs of the U-shaped base member to receive the first pivot pin to pivotally connect the handle to the base.

The base components just described are configured to provide a number of features. The mounting leg of the L-shaped base member defines one surface that is engaged by one set of handle-carried stop formations when the handle is fully "closed." The end leg of the L-shaped base member defines another surface that is engaged by another set of handle-carried stop formations when the handle is fully "open." Opposed edge surfaces of the end leg extend between and in relatively close proximity to opposed arms of the drawbar at times when the latch is "latched"—to thereby reinforce the drawbar against being twisted or otherwise deformed. The upstanding front and rear legs of the U-shaped base member are configured to extend about a portion of the circumference of the second pivot pin when the handle is closed to similarly provide reinforcement.

To summarize, in preferred practice, the present invention provides a handle operated, toggle type draw latch of rugged design that advantageously incorporates a number of desirable features while employing a simple set of well-designed, highly interactive components, with some of the components of the latch bearing similarity to latch components that are disclosed in the two utility that are referenced above.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Referring to FIGS. 1–15, a heavy duty, handle operated draw latch assembly with safety catch incorporating features of the preferred practice of the present invention is indicated generally by the numeral 100. Because many of the features of the latch assembly 100 are arranged in a substantially symmetrical manner about an imaginary "center plane," reference is made to FIGS. 3, 10 and 12–15 wherein what will be referred to as the "center plane" of the latch assembly 100 is indicated generally by the numeral 125.

In the detailed description that follows, orientation terms such as "front," "rear," "left" and "right," and orientation expressions such as "leftwardly extending," "rightwardly extending," "vertically extending" and "horizontally extending" are not intended to be viewed as suggesting that the latch assembly 100 can only be used if oriented in a particular manner. Rather, orientation terms and expressions are used merely as an expedient in rendering the description clear and easy to follow, as those who are skilled in the art will readily understand. Indeed, a significant feature of the latch assembly 100 resides in the fact that it can be used in a wide variety of orientations, especially inasmuch as the latch assembly 100 has a "safety catch" 300 that not only will serve to releasably retain an associated operating handle 200 in its closed position, but also can be "padlocked" to further ensure that, regardless of latch orientation, the operating handle 200 will be securely retained in its closed position.

Figure 2:
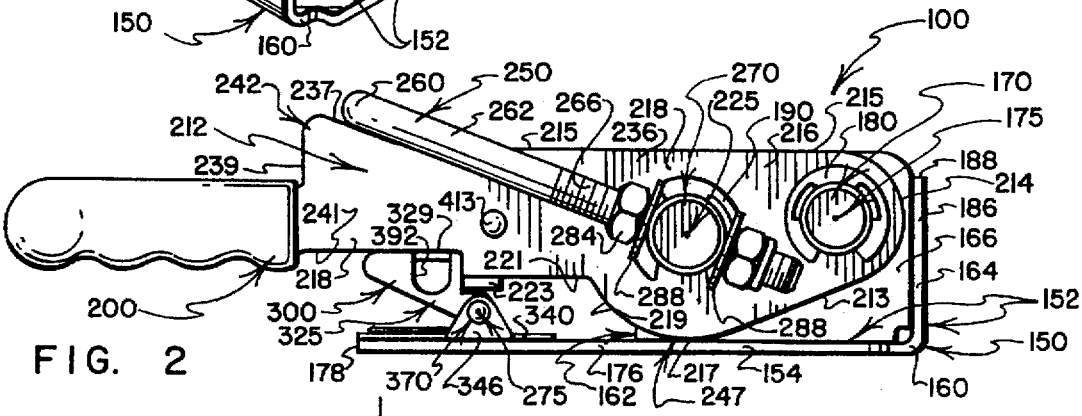
FIG. 2 is a rear side elevational view thereof, with the components thereof positioned in agreement with what is depicted in FIG. 1.

With the exception of FIG. 2 (which is deliberately "reversed" relative to the other drawing views to depict rear side features of the latch 100), it will be understood that when a latch component is said to be "left" or "leftwardly extending" in character, such component is likely to be found toward the left side (except in FIG. 2 where "left" components appear toward the right side). Likewise, "right" and "rightwardly extending" components are likely to be found toward the right side (except in FIG. 2 where "right" components appear toward the left side).

In top plan views (see FIGS. 3, 10 and 12–15), components or features located below a horizontally extending center plane line 125 will be said to be "front" or "forwardly extending" in character, while components or features located above the center plane line 125 will be said to be "rear" or "rearwardly extending" in character.

In front and rear side elevational views (see FIGS. 5–9 and FIG. 2, respectively), components or features located toward the bottom of these views will be said to be "bottom" or "downwardly extending" in character, while components or features located above bottom portions of these views will be said to be "top" or "upwardly extending" in character. Components or features extending vertically or horizontally in these FIGURES will be said to be "vertically extending" or "horizontally extending," respectively.

In overview, and referring variously to FIGS. 1–15, the latch assembly 100 includes among its more major components a base assembly (or "base") that is indicated generally by the numeral 150, an elongate handle assembly (or "handle") that is indicated generally by the numeral 200, a U-shaped drawbar assembly (or "drawbar") that is indicated generally by the numeral 250, and a safety catch assembly (or "safety catch") that is indicated generally by the numeral 300. A first pivot pin 170 extends along an axis 175 to pivotally interconnect the base 150 and the handle 200. A second pivot pin 270 extends along an axis 225 to pivotally interconnect the handle 200 and the drawbar 250. A third pivot pin 370 extends along an axis 275 to pivotally interconnect a latching component 325 of the safety catch 300 to a mounting bracket 340 of the safety catch 300 that is welded to the base 150.

Figure 7:
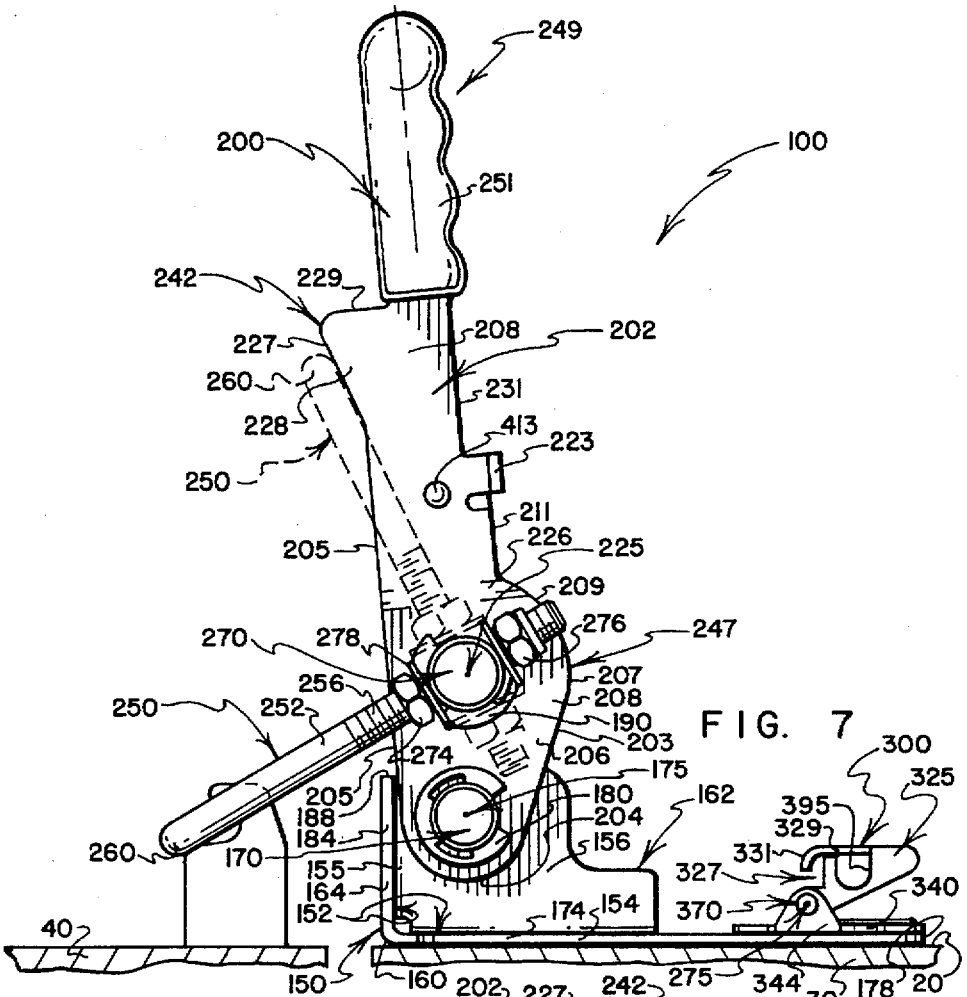
FIG. 7 is a front side elevational view of the mounted latch assembly and of a latch-engageable post formation that is connected to a member that is to be joined to the member on which the latch assembly is mounted, with the members on which the latch assembly and the latch-engageable post formation are mounted being spaced relatively far apart, with the handle shown pivoted to its "fully open" position, with the drawbar shown in solid lines as as having been pivoted to an extended position wherein the drawbar embraces the latch-engageable post formation (and shown in phantom in a retracted position), and with the safety catch shown in its normal, non-operated position.

Referring to FIGS. 7–11, the handle operated draw latch assembly 100 typically is used in concert with a suitably configured latch-engageable post formation such as is indicated generally by the numeral 50. An enlarged head or a hook-shaped formation 52 is provided atop the post 50. In preferred practice, the latch assembly 100 is mounted atop a surface 20 of one of two relatively movable members 30, 40 that are to be "joined" by drawing the members 30, 40 relatively toward each other from a separated position, such as is depicted in FIG. 7, to a more closely juxtaposed position, such as is depicted in FIGS. 8–11. The "drawing together" function of the latch assembly 100 has caused the term "draw latch" to be relatively commonly associated with latches that perform such a function.

Moreover, because the latch assembly 100 has handle and drawbar components 200, 250 that are pivotally connected for relative movement about the pivot axis 225, with the handle 200 being pivotally connected to the base 150 for relative movement about the pivot axis 175, and with the drawbar 250 in essence establishing a "partially pivotal connection" with the latch-engageable post formation 50 (compare how the drawbar 250 is angled upwardly in FIG. 7 with how the drawbar is more nearly horizontally inclined in FIGS. 8 and 9), the pivotally interconnected "links" 200, 250 are viewed by some as constituting "toggle links" that are alignable "on center" and that pass "over center" to utilize such forces as are incurred by the components 200, 250 to selectively assist in effecting "latching" and "unlatching" movements—which arrangement has given rise to this general type of latch being referred to as a "toggle type latch," or more simply as a "toggle latch."

Referring to FIGS. 1, 4 and 12–15, the base 150 is an assembly formed from an L-shaped member 152 and a U-shaped member 162. The L-shaped member 152 has a relatively long, horizontally extending, generally rectangular mounting leg 154, and a relatively shorter, vertically extending, generally rectangular end leg 164. The legs 154, 164 are formed integrally with each other, and are joined by a right angle bend 160. Each of the legs 154, 164 extends symmetrically about the center plane 125—which is to say that each of the legs 154, 164 has front and rear "halves" that are "mirror images" of each other and that are located on opposite sides of the center plane 125.

Referring to FIGS. 1–4 and 14–15, the mounting leg 154 of the L-shaped member 152 has front and rear edge surfaces 174, 184 that extend from the right angle bend 160 to a right end region 178 of the leg 154. Similarly, the end leg 164 of the L-shaped member 152 has front and rear edge surfaces 176, 186 that extend from the right angle bend 160 to an upper end region 188 of the leg 164 —it being remembered that "left" and "right" are "reversed" in FIG. 2.

Figure 4:
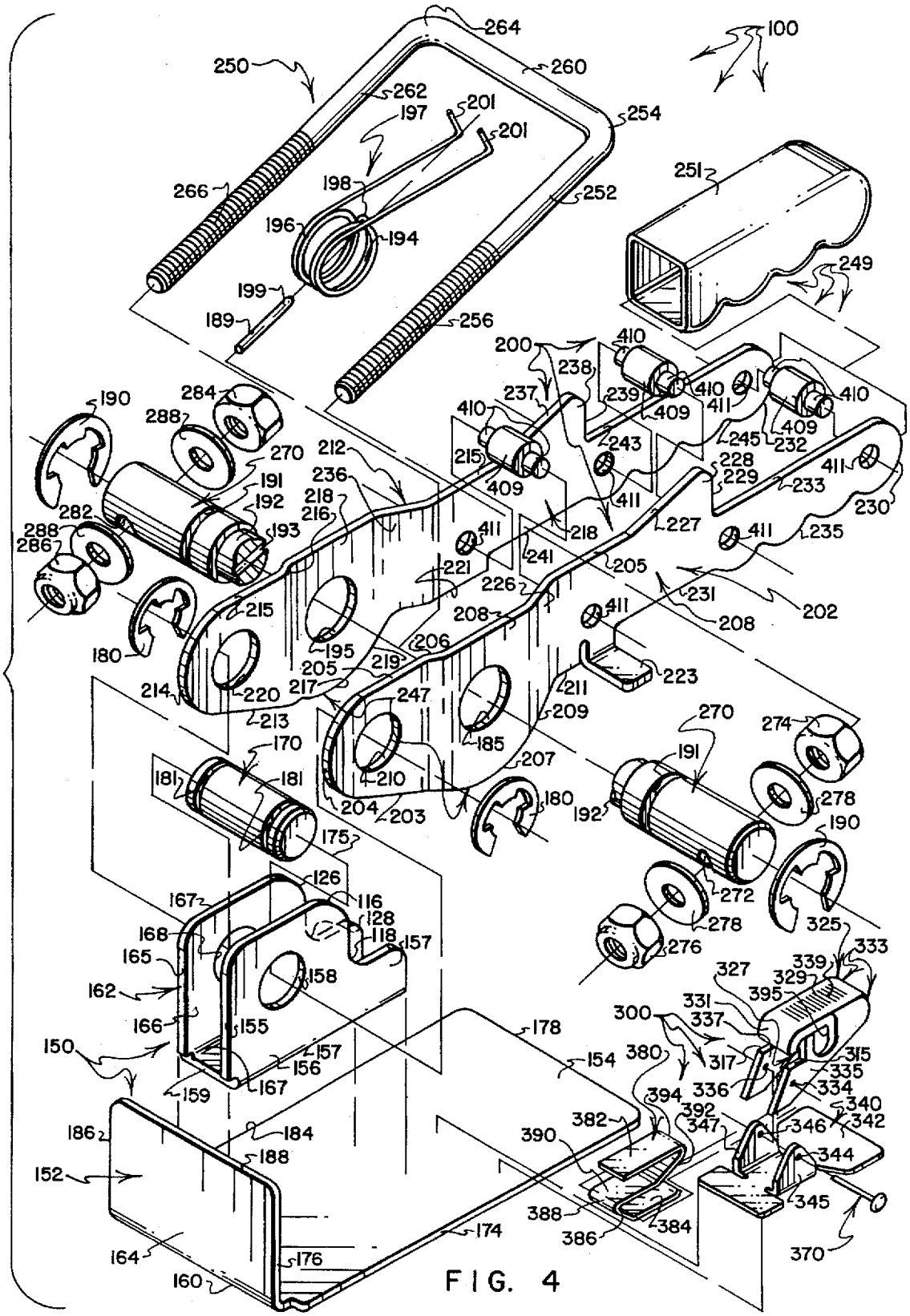
FIG. 4 is an exploded perspective view showing components of the latch assembly.

Referring to FIG. 4, the U-shaped member 162 has front and rear legs 156, 166 that extend in spaced, vertically extending planes that are located on opposite sides of and that parallel the center plane 125. Left end regions 155, 165 of the front and rear legs 156, 166 are rigidly connected to the upstanding end leg 164 by welding. Bottom end regions of the front and rear legs 156, 166 are connected by right angle bends 157, 167 to a horizontally extending base leg 159 of the U-shaped member 162. The base leg 159 rests atop the mounting leg 154 and is welded thereto in the vicinities of the right angle bends 157, 167. By this arrangement, the L-shaped member 152 and the U-shaped member 162 cooperate to mutually reinforce each other.

Figure 13:
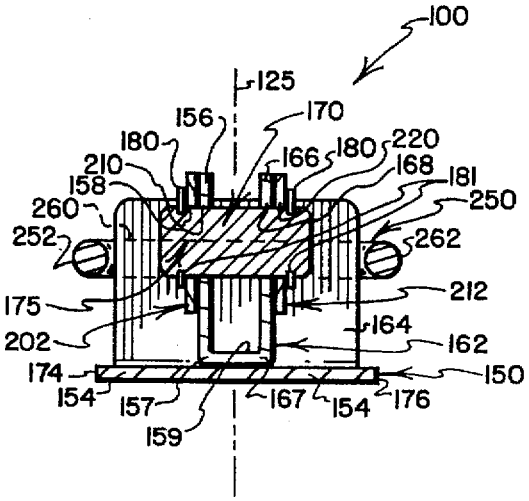

Referring to FIGS. 4 and 13, aligned holes 158, 168 are formed through the front and rear legs 156, 166 to receive a first pivot pin 170 in a slip fit. The holes 158, 168 extend coaxially about the pivot axis 175. When the pivot pin 170 is positioned in the aligned holes 158, 168, the pivot pin 170 also extends coaxially about the pivot axis 175.

Figure 5:
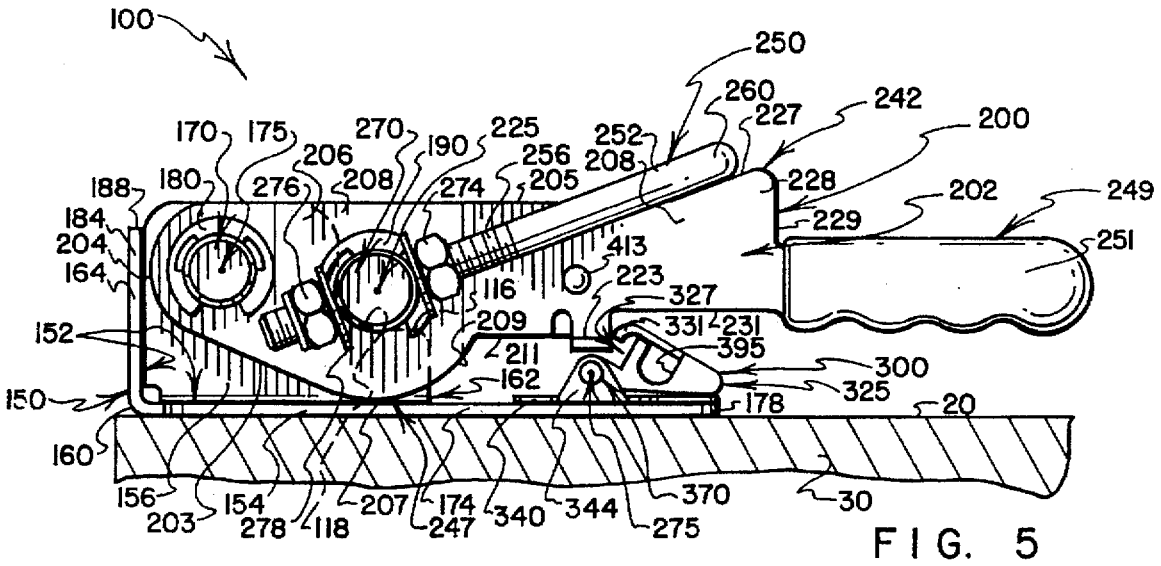
FIG. 5 is a front side elevational view of the latch assembly shown mounted on a surface that is defined by a member that extends beneath the latch assembly, with the handle shown in its closed position, with the drawbar shown in its retracted position, and with the safety catch shown pivoted to an operated position.

Referring to FIG. 4, the front and rear legs 156, 166 of the U-shaped member 162 have complexly shaped, multi-curved edges 116, 126 that extend from the left ends 155, 165 of the front and rear legs 156, 166 to the right angle bends 157, 167 of the U-shaped member 162. While the majority of the curves that are defined by the multi-curved edges 116, 126 are convex in nature, two congruently extending concave curves 118, 128 also are defined. It is the purpose of the concavely curved regions 118, 128 to assist the handle 200 and the base 150 in stabilizing the position of the second pivot pin 270 when the handle 200 is latched in its "fully closed" position, as is depicted in FIGS. 1–3 and 9–11). Referring to FIG. 5, for example, a hidden line depicting the complexly curved edge 116 shows how the concavely curved region 118 wraps closely about a lower left quadrant portion of the circumference of the pivot pin 270 when the handle 200 is "fully closed." Likewise, in FIG. 11, portions of the curve 126 are shown extending into close proximity to a lower left quadrant portion of the circumference of the pivot pin 270.

Because the curved regions 118, 128 extend relatively closely about left, lower quadrant portions of the circumference of the second pivot pin 270 when the handle 200 is "fully closed," the curved regions 118, 128 cooperate with the handle 200 to help keep the second pivot pin 270 in place when the handle 200 is "fully closed." If heavy loadings are imposed on the drawbar 250 so that the front and rear legs 252, 262 apply force to opposite end regions of the second pivot pin 270 that tends to draw the pivot pin 270 leftwardly and downwardly, the engagement of the curved regions 118, 128 with lower left quadrant portions of the circumference of the pivot pin 270 will help to resist unwanted movement of the pivot pin 270 in response thereto.

To mount the welded base assembly 150 atop the surface 20 of the underlying member 30, suitable holes (not shown) can be drilled through the mounting leg 154 to receive suitable fasteners such as bolts (not shown). Alternatively, the mounting leg 154 can be welded in place as by utilizing conventional welding techniques.

Figure 1:
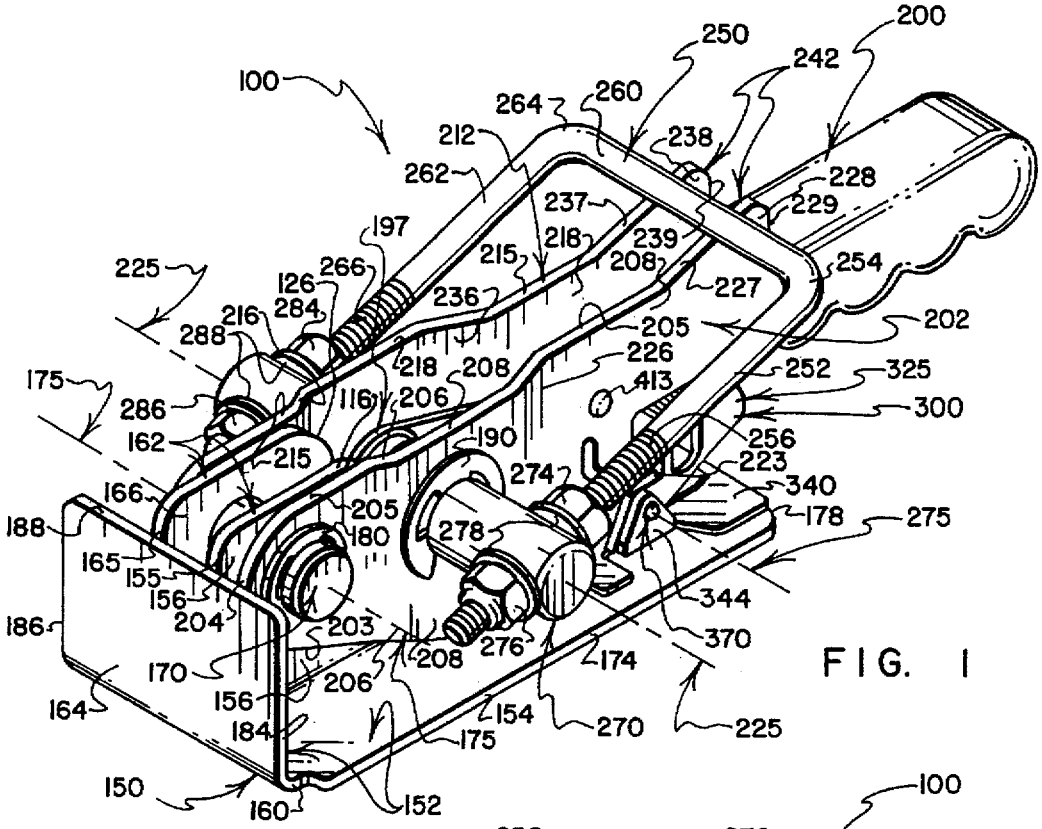
FIG. 1 is a perspective view of a heavy duty, handle operated, toggle type draw latch that embodies the preferred practice of the present invention, with the view showing a handle of the latch assembly in its closed position, showing a drawbar of the latch assembly in its retracted position, and showing a safety catch in its normal, non-operated position.
Figure 3:
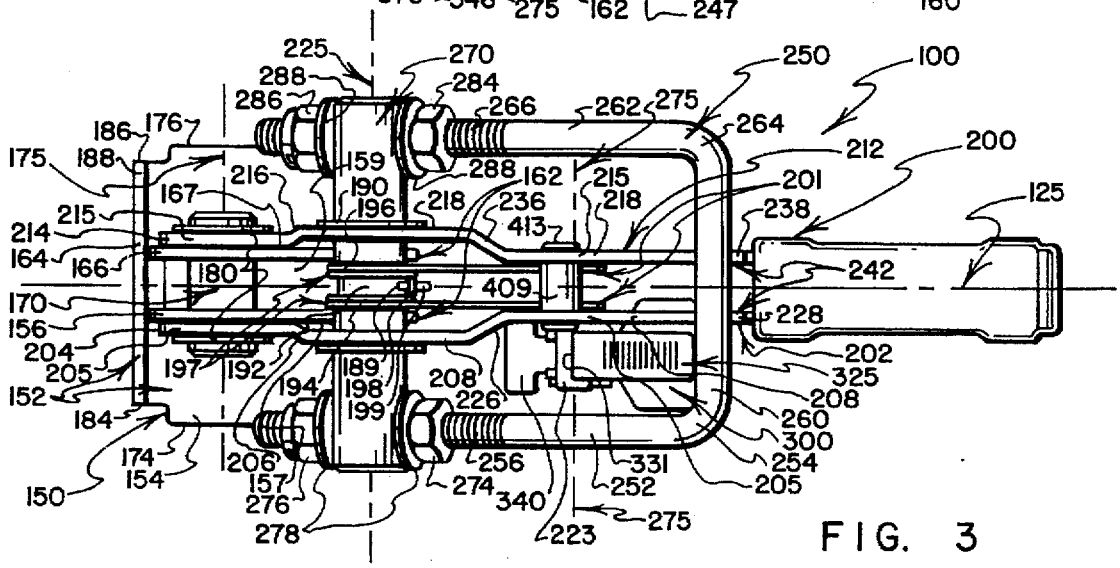
FIG. 3 is a top plan view thereof, with the components thereof positioned in agreement with what is depicted in FIGS. 1 and 2.

Referring to FIGS. 1, 3 and 4, the handle 200 is an elongate structure that is formed as an assembly of elongate front and rear members 202, 212 that are, for the most part, substantially identical except that the front member 202 is a mirror image of the rear member 212, and vice versa. Actually, the front handle member 202 does differ slightly from being a true mirror image of the rear handle member 212 in that the front handle member 202 defines a formation that is not present on the rear handle member 212, namely a forwardly-extending catch-engagement formation 223 that is located about mid-way along the length of the front handle member 202.

Figure 10:
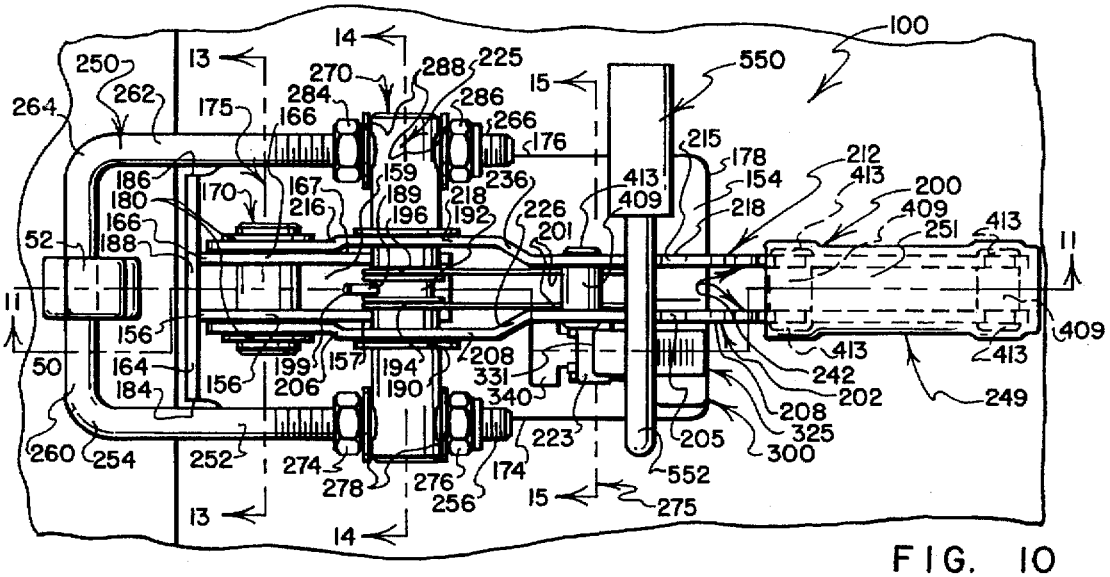
FIG. 10 is a top plan view similar to FIG. 3 but with the view showing both the latch assembly and the latch-engageable post formation, with the drawbar shown embracing the latch-engageable post formation, and with the handle locked closed and the safety catch locked in its normal position by means of a padlock that is installed on the latch assembly.
Figure 11:
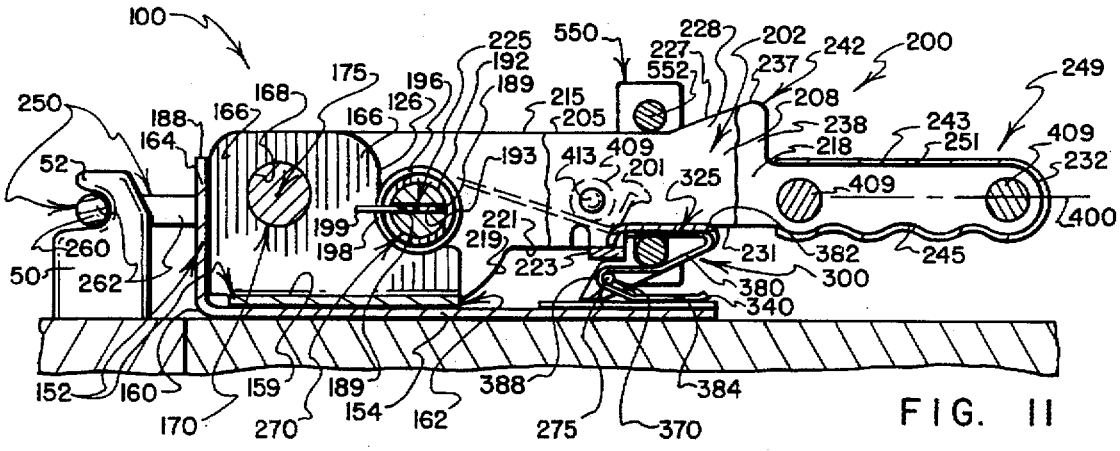
FIG. 11 is a sectional view as seen from planes that are indicated by the broken line 11—11 in FIG. 10.
Figure 12:
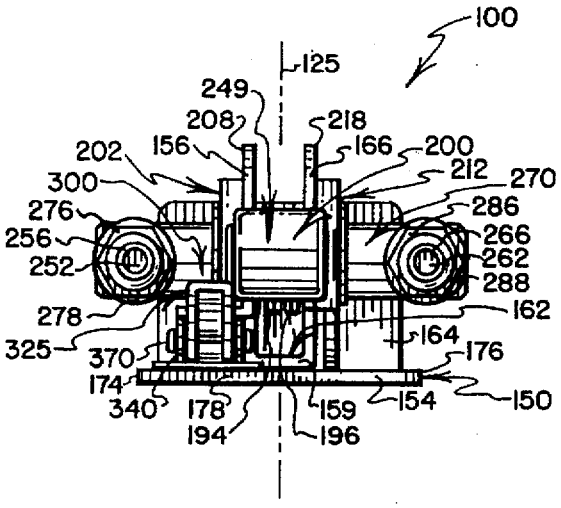
FIG. 12 is a right end elevational view of the mounted latch assembly with the components thereof positioned as is depicted in FIGS. 10 and 11; and, FIGS. 13, 14 and 15 are sectional views as seen from planes that are indicated by lines 13—13, 14—14 and 15—15 in FIG. 10, respectively.
Figure 14:
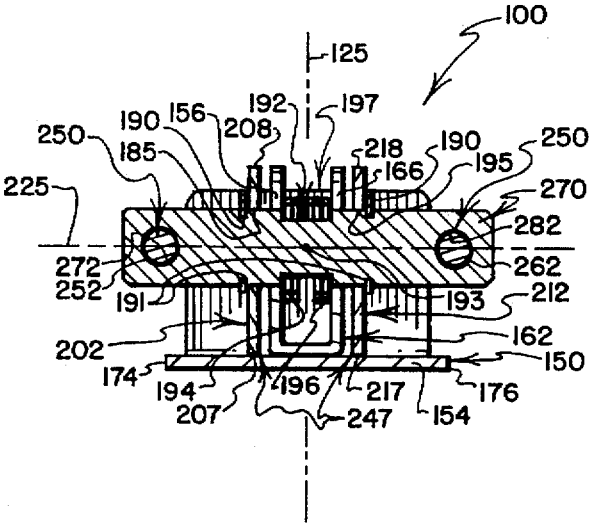
Figure 15:
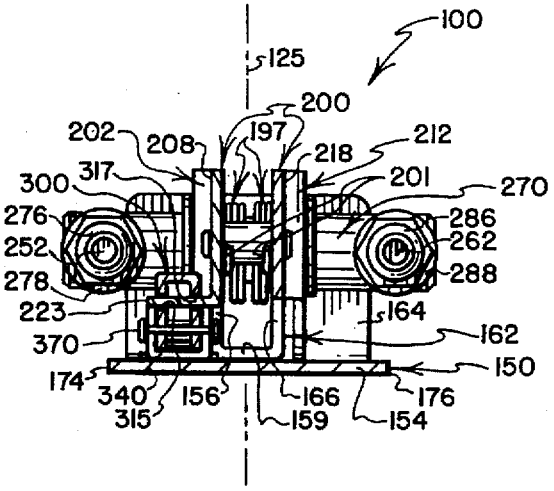

Referring to FIGS. 4, 10 and 11, the front and rear handle members 202, 212 have flat rightwardly extending portions 208, 218 that are held in spaced relationship by generally cylindrical spacers 409 that have reduced diameter end regions 410 (see FIG. 4) that extend through holes 411 (see FIG. 4) formed in the handle members 202, 212. The end regions 410 are riveted to provide headed formations 413 (see FIG. 10 wherein two of the formations 413 are shown in solid lines, and four of the formations 413 are depicted by hidden lines), whereby the front and rear handle members 202, 212 are rigidly interconnected. The fact that the rigidly interconnected handle members 202, 212 are spaced apart by the cylindrical spacers 409 enhances the moment of inertia of transverse cross-sections of the handle 200 (e.g., such handle cross-sections as are depicted in FIGS. 13–15) at locations all along the length of the handle assembly 200—to thereby enhance the ability of the handle assembly 200 to resist twisting and other forms of deformation.

Referring principally to FIG. 4 (see also FIG. 11), the front and rear handle members 202, 212 have rounded left end regions 204, 214 and rounded right end regions 230, 232, respectively. At the right end of the handle assembly 200, a handgrip 249 is defined by a plastic sleeve 251 that wraps about the right end regions 230, 232. Enclosed by the plastic sleeve 251 are flat top surfaces 233, 243, wave-form bottom surfaces 235, 245, and the connecting rounded left end regions 204, 214. The plastic sleeve 251 preferably is formed from a heat shrinkable plastic material, and is heat shrunk in place on the handle members 202, 212 to cooperate with the handle members 202, 212 in defining the handgrip 249.

Figure 8:
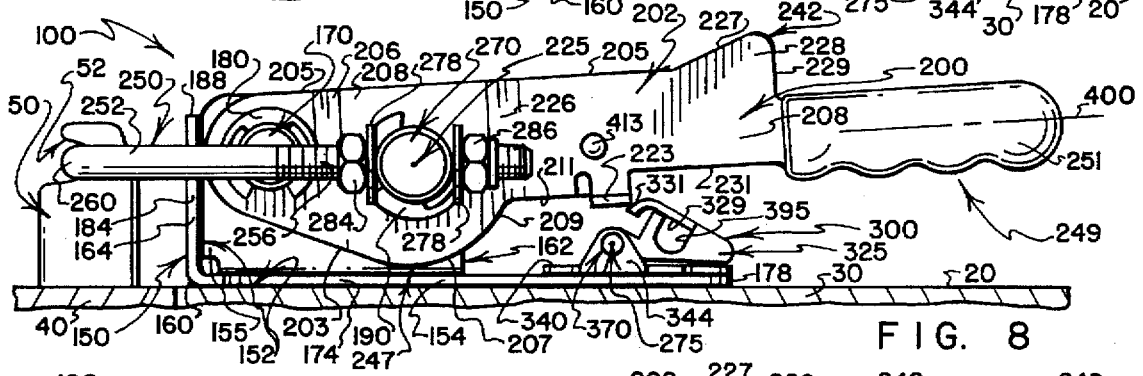
FIG. 8 is a front side elevational view of the mounted latch assembly and mounted latch-engageable post formation, with the members on which the latch assembly and the latch-engageable post formation are mounted having been drawn together as the handle was pivoted from the "fully open" position that is depicted in FIG. 7 to the nearly closed position that is depicted in FIG. 8, with the drawbar shown embracing the latch-engageable post formation, and with the safety catch in the process of being cammed toward its operated position by a cam-engageable formation that is carried by the handle.
Figure 9:
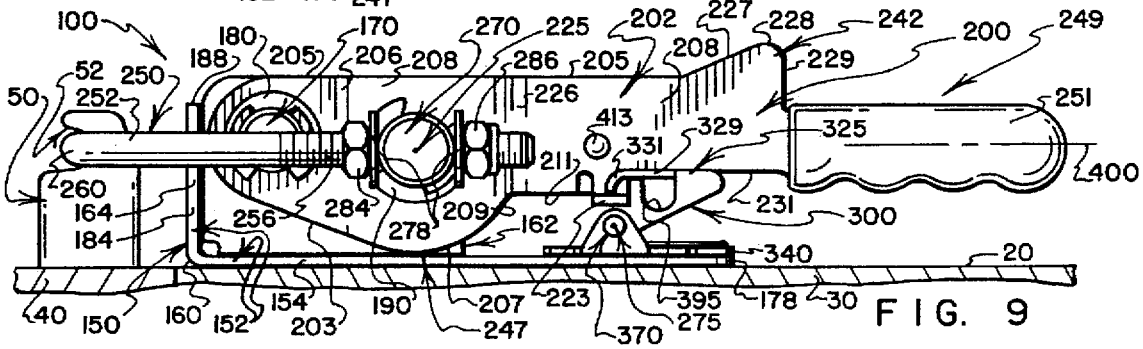
FIG. 9 is a front side elevational view of the mounted latch assembly and mounted latch-engageable post formation, with the members on which the latch assembly and the latch-engageable post formation having been drawn together as the two members on which the latch assembly and the post formation were joined by operating the latch assembly, with the handle shown in its closed position, with the drawbar shown embracing the latch-engageable post formation, and with the safety catch shown in its normal, non-operated position wherein (when the handle is "fully closed" as is depicted) the safety catch functions to releasably retain the handle in its closed position.

Referring to FIGS. 8 and 9, what will be referred to herein as an "imaginary centerline" is shown extending centrally through the handgrip 249 and is designated by the numeral 400. The imaginary centerline 400 parallels the length of the elongate handle assembly 200 so as to extend through the rounded left end region of the handle assembly 200 (as defined by the rounded left end regions 204, 214) and through the rounded right end region of the handle assembly 200 (as defined by the rounded right end regions 230, 232). If the imaginary centerline 400 were to be depicted in FIG. 3, it would be coincident with the center plane line that is designated by the numeral 125.

Referring to FIG. 1, the spaced front and rear handle members 202, 212 have upwardly projecting, generally triangular shaped formations 228, 238 that are located just to the left of the handgrip 249. The triangular shaped formations 228, 238 define inclined top surfaces 227, 237 and rightwardly facing surfaces 229, 239 that are smoothly joined by rounded "corners." The side-by-side arrangement of the triangular shaped formations 228, 238 forms what will be referred to as a "triangular shaped stop," which is indicated generally by the numeral 242.

Referring to FIG. 4, extending leftwardly from the triangular shaped formations 228, 238 are flat top surfaces 205, 215. Underlying the flat top surfaces 205, 215 and the triangular shaped formations 228, 238 are flat bottom surfaces 231, 241. Other features of the front and rear handle members 202, 212 will be described beginning generally from the vicinities of the rounded left end regions 204, 214 and extending rightwardly along the length of the handle members 202, 212.

Referring to FIGS. 3 and 10, the rounded left end regions 204, 214 are spaced equally from the center plane 125 at a distance that is sufficient to permit the end regions 204, 214 to extend in a yoke-like manner closely along forwardly and rearwardly facing surfaces 157, 167 of the abuttingly engaged upstanding legs 156, 166 of the U-shaped base member 162. Referring to FIG. 4, while the pair of left end regions 204, 214 extend in spaced, substantially parallel planes, the regions 204, 214 are joined by a pair of oppositely angled portions 206, 216 which provide transitions to a pair of more widely spaced handle portions 208, 218 that also extend in spaced, substantially parallel planes. Extending rightwardly from the handle portions 208, 218 are oppositely angled portions 226, 236 that connect with the spaced, parallel, rightwardly extending handle portions 208, 218.

Referring to FIG. 4, extending rightwardly from the rounded left end regions 204, 214 and defining lengthy top surface reaches of the handle members 202, 212 are flat top surfaces 205, 215 that join eventually with the upwardly inclined surfaces 227, 237 of the stop formation 242. Also extending rightwardly from the rounded left end regions 204, 214 of the handle members 202, 212 are flat bottom surfaces 203, 213. The flat bottom surfaces 203, 213 underlie the angled transition portions 206, 216 and join smoothly with rounded bottom surface formations 207, 217 that underlie the widely spaced formations 208, 218. At their lowest point, the rounded bottom formations 207, 217 cooperate to define a stop 247 that engages the base members 152, 162 when the handle 200 is in its "closed" position, as is depicted in FIGS. 1–3 and 9–11, and as is shown in the sectional view of FIG. 14.

The rounded bottom surface formations 207, 217 that define the stop formation 247 join with upwardly curved, rightwardly extending bottom surface portions 209, 219 that also underlie the widely spaced formations 208, 218. The curved surfaces 209, 219 join with flat surface portions 211, 221 that underlie the regions 226, 236.

Referring to FIG. 4, the flat surface 211 of the front handle member 202 extends rightwardly to a point where the bottom surface of the front handle member 202 is cut away adjacent the provision of the forwardly extending, generally flat, catch-engaging formation 223. From the right side of the catch-engaging formation 223, the flat bottom surface 231 extends rightwardly to join with the wave-form bottom surface 233 that forms a part of the handle grip 249. Likewise, the rear handle member 212 has a bottom surface 241 that is partially defined by the flat bottom surface portion 233 that underlies the stop formation 242 and joins with the wave-form bottom surface 243.

Aligned holes 210, 220 (see FIGS. 4 and 13) are formed through the rounded left end regions 204, 214 of the front and rear handle members 202, 212, respectively. The aligned holes 210, 220 extend coaxially about the first pivot axis 175, receive the first pivot pin 170 in a slip fit, and orient the first pivot pin 170 to extend coaxially along the first pivot axis 175. Spring retainer clips 180 engage grooves 181 that are formed in opposite end regions of the first pivot pin 170 and extend along a front face of the front handle member 202 and along a rear face of the rear handle member 212 to secure the first pivot pin 170 in place.

The first pivot pin 170 pivotally mounts the handle 200 on the base 150 for movement between what are referred to as "fully open" and "fully closed" positions. The "fully closed" position of the handle 200 is depicted in FIGS. 1–3 and 9–11. The handle 200 is "fully open" when it has been pivoted about the axis 175 of the first pivot pin 170 ("counterclockwise" as viewed in FIGS. 5–9 and 11, but "clockwise" as viewed in FIG. 2) to a position when the flat top surfaces 205, 215 of the handle members 202, 212 engage the rightwardly facing surface of the upstanding end leg 164 of the L-shaped member 152, as is depicted in FIG. 7. The handle 200 is "fully closed" when it has been pivoted about the axis 175 of the first pivot pin 170 ("clockwise" as viewed in FIGS. 5–9 and 11, but "counterclockwise" as viewed in FIG. 2) to a position wherein the convexly rounded surfaces 207, 217 that define the handle-carried "stop" formation 247 engage the upwardly facing surface of the mounting leg 154 of the L-shaped base member 152, as is depicted in FIGS. 1–3, 5 and 9–11. When the handle 200 is "fully closed," the catch-engaging formation 223 normally is latchingly engaged by the catch 300 (see FIGS. 1–3 and 9–11)—unless the pivotally mounted catch member 325 has been pivoted to its unlatched position (see FIG. 5).

Aligned holes 185, 195 (see FIGS. 4 and 14) are formed through the widely spaced portions 208, 218 of the front and rear handle members 202, 212, respectively. The aligned holes 185, 195 extend coaxially about the second pivot axis 225, receive the second pivot pin 270 in a slip fit, and orient the second pivot pin 270 to extend about the pivot axis 225. Spring retainer clips 190 engage grooves 191 that are formed in portions of the second pivot pin 270 that are located equidistantly from but on opposite sides of the center plane 125. The clips 190 extend along a front face of the front handle member 202 and along a rear face of the rear handle member 212 to secure the second pivot pin 270 in place.

Referring to FIGS. 4, 11 and 14, the second pivot pin 270 has a central region 192 that is of reduced diameter. A coil-formed pin 189 is driven part way into a hole 193 that is formed diametrically through the reduced diameter central region 192 at a location that extends within the center plane 125 (i.e., at a location that is mid-way along the length of the second pivot pin 270).

Referring still to FIGS. 4, 11 and 14, a torsion coil spring 197 has a central portion 198 that connects with a projecting end region 199 of the coil-formed pin 191. The torsion coil spring 197 also has front and rear coils 194, 196 that are located on opposite sides of the pin 191 and that wrap loosely about the reduced diameter central region 192 of the second pivot pin 270. Additionally, the torsion coil spring 197 has opposed, hook-shaped end regions 201 that engage the left-most one of the three cylindrical spacers 409 that rigidly interconnect the front and rear handle members 202, 212.

The torsion coil spring 197 biases the second pivot pin 270 clockwise relative to the handle 200 (i.e., "clockwise" when the latch 100 is viewed in front side elevation, as in FIGS. 5–9) to bias the drawbar 250 toward its retracted position (the drawbar 250 is depicted in its retracted position in FIGS. 1–3 and 5). When the drawbar 250 is in its retracted position, a crossbar 260 of the drawbar 250 engages the inclined surfaces 227, 237 of the stop formation 242, as is depicted in solid lines in FIGS. 1–3 and 5–7, and in phantom in FIGS. 6 and 7.

Referring principally to FIG. 4, the drawbar 250 is a U-shaped structure that has front and rear leg portions 252, 262 that are interconnected by a transversely extending cross-leg 260. Rounded bends 254, 264 are provided where the front and rear leg portions 252, 262 join with the cross-leg 260. Threaded end regions 256, 266 are defined by the front and rear leg portions 252, 262, respectively. The threaded end regions 256, 266 extend through holes 272, 282 that are formed through the second pivot pin 270 (see FIG. 14). Tightly fitting nuts 274, 284 and locknuts 276, 286 are threaded onto the threaded end regions 256, 266 at locations on opposite sides of the holes 272, 282 that extend through the second pivot pin 270. Washers 278 are clamped between the nuts 274, 276 and a front end region of the second pivot pin 270. Washers 288 are clamped between the nuts 284, 286 and a rear end region of the second pivot pin 270.

The purpose for providing the threaded end regions 256, 266 and the nuts 274, 284 and 276, 286 is to permit the "effective length" of the crossbar 250 (i.e., the distance between the crossleg 260 of the drawbar 250 and the pivot axis 225 of the second pivot pin 270) to be adjusted as may be needed to permit the latch assembly 100 to properly engage and apply force to the latch-engageable formation 50. Because the tight fitting nuts 274, 284 and the locknuts 276, 286 can be adjusted along the threaded end regions 256, 266, the line of engagement along which the crossleg 260 of the drawbar 250 engages the inclined surfaces 227, 237 of the stop formation 242 will vary when the drawbar 250 is retracted as is depicted in FIGS. 1–3 and 5. However, the length and location of the inclined surfaces 227, 237 (the surfaces 227, 237 are referred to later herein by the expression "drawbar engaging surface") is sufficient to ensure that the crossbar 260 will not extend beyond the upstanding end surfaces 229, 239 of the stop formation 242 but rather will always engage the inclined surfaces 227, 237—and will therefor always be prevented from engaging the handgrip formation 249 that is provided near the right end regions 230 of the handle 200.

Stated in another way, the "drawbar engaging surface" that is defined by the surfaces 227, 237 is planar in character in that it extends substantially within a common plane that is inclined relative to the "imaginary centerline" 400, 1) so as to more closely approach the "imaginary centerline" 400 as the "drawbar engaging surface" extends away from the handgrip 249, and 2) so as to extend progressively farther from the "imaginary centerline" 400 the closer the "drawbar engaging surface" approaches the handgrip 249.

Referring to FIGS. 1–12 and 15, the safety catch 300 includes the mounting bracket 340, the pivotally movable catch member 325, the pivot pin 370 that mounts the catch member 325 on the bracket 340 for pivotal movement about the third pivot axis 275, and a generally Z-shaped leaf spring 380.

Referring to FIG. 4, the mounting bracket 340 has a generally H-shaped bottom structure 342 that is welded to the mounting leg 154 of the L-shaped base member 152. The location of the bracket 340 atop the mounting leg 154 is selected to position front and rear upwardly turned arm portions 345, 347 of the bracket 340 so that aligned holes 344, 346 that are formed through the arm portions 345, 347 to mount the pivot pin 370 position the pivot pin 370 and its pivot axis 275 directly beneath the position that is occupied by the catch-engagement formation 223 when the handle 200 is in its closed position, as is depicted in FIGS. 1–3, 5 and 9–12.

Referring to FIG. 4, the pivotally mounted catch member 325 has a top wall 329 that has a smoothly curved, downwardly extending left end region 331, and a smoothly rounded right end region 333. The catch member 325 has a pair of generally triangular shaped front and rear arm portions 335, 337 that depend from smoothly rounded junctures with the top wall 329 to extend in juxtaposed relationship with the upwardly turned arm portions 345, 347 of the mounting bracket 340. Aligned holes 334, 336 are formed through the arm portions 335, 337, through which the pivot pin 370 is received in a slip fit to pivotally mount the catch member 325 on the mounting bracket 340.

Referring to FIG. 4, the top surface of the top wall 329 of the pivotally mounted catch member 325 is provided with a series of upwardly-facing thumb-grip indentations 339 that help to retain one's thumb in place atop the catch member 325 for operating the catch member 325 by depressing the right end region 333 of the catch member 325 to pivot the catch member 325 about the third pivot axis 370 to the unlatched position that is depicted in FIG. 5. The catch member 325 has a latching notch 327 that is defined in part by aligned notches 315, 317 that are formed in the depending front and rear arm portions 335, 337.

When the latching notch 327 of the catch member 325 receives the catch-engagement formation 223 of the handle 200 (as is best seen in FIGS. 1, 9 and 11), the handle 200 is said to be "latched closed" inasmuch as the handle 200 is prevented thereby from pivoting out of its "fully closed" position until the catch member 325 is pivoted to its unlatched position (as is depicted in FIG. 5).

Referring to FIG. 8, a feature of the catch member 325 is that the rounded left end region 331 of the top wall 329 is configured to be engaged by the catch-engagement formation 223 during movement of the handle 200 toward its closed position. As the handle 200 is pivoted progressively toward its closed position, the handle-carried catch-engagement formation 223 progressively cams the base-carried catch member 325 to pivot the catch member 325 in opposition to the biasing action of the leaf spring 380. As the catch member 325 is progressively caused to pivot away from its latched position toward its unlatched position, the latch-engagement formation 223 slides progressively along the rounded left end region 331 of the top wall 329 of the catch member 325. The sliding of the latch-engagement formation 223 along the rounded left end region 331 continues until the formation 223 drops beneath the end surface 319 of rounded left end 331 and into the latching notch 327, whereupon the handle 220 attains its closed position as the biasing action of the leaf spring 380 snaps the pivotally mounted catch member 325 back to its latched position—whereby the latch-engagement formation 223 is received within the latching notch 327 of the safety catch 300 (i.e., the handle 200 is "latched closed").

Referring to FIG. 4, the Z-shaped leaf spring 380 has a relatively flat upper reach 382 that underlies the top wall 329 of the pivotally mounted catch member 325 and biases the pivotally mounted catch member 325 toward a latched position that is depicted in FIGS. 1–3, 6, 7, 9–12 and 15. The leaf spring 380 has a relatively flat lower reach 384 that rests atop portions of the mounting bracket 340; an upwardly inclined left portion 386 that extends between the left end of the lower reach 384 and a smoothly rounded bend 388; a flat central reach 390 that extends rightwardly from the bend 388; and an upwardly inclined right portion 392 that extends between the right end of the center reach 390 and a bend 394 that joins with the right end of the upper reach 382.

Referring to FIG. 11, the curved bend 388 extends about portions of the pivot pin 370 to prevent unwanted rightward movement of the leaf spring 380. Unwanted leftward movement of the leaf spring 380 is prevented by the left end region of the upper reach 382 extending adjacent the downwardly turned end region 331 of the top wall 329. Thus, the generally Z-shaped leaf spring 380 tends to be held in place once it has been interposed as described between the mounting bracket 340 and the pivotally mounted catch member 325.

A feature of the pivotally mounted catch member 325 is that its downwardly turned front and rear arms 335, 337 define relatively large aligned apertures 395, 397 (although the aperture 395 is easily discerned in FIG. 4 and other views, the aperture 397 is best seen in FIG. 2) formed therethrough at a location just beneath the top wall 329 for receiving the shackle 552 of a padlock 550 that can be installed on the latch assembly 100, as is depicted in FIGS. 10 and 11. Because the safety catch assembly 300 is securely connected to the front base member 152, the effect of installing the padlock shackle 552 through the aligned apertures 395, 397 in a manner that also embraces portions of the handle 200 (as shown in FIGS. 10 and 11) is a) to secure the safety catch 300 (i.e., to prevent the catch member 325 from pivoting away from its latched position toward its unlatched position), and b) to concomitantly lock the handle 200 to the base 150.

In operation, the various components of the latch assembly 100 normally assume the positions depicted in FIG. 1 when the latch assembly 100 is not being used to engage the latch-engagement formation 50. In the positions depicted in FIG. 1, the handle 200 is latched closed by the safety catch 300, and the drawbar 250 is held in its retracted position (with its crossleg 260 engaging the stop formation 242 of the handle 200) by the action of the torsion coil spring 197.

Figure 6:
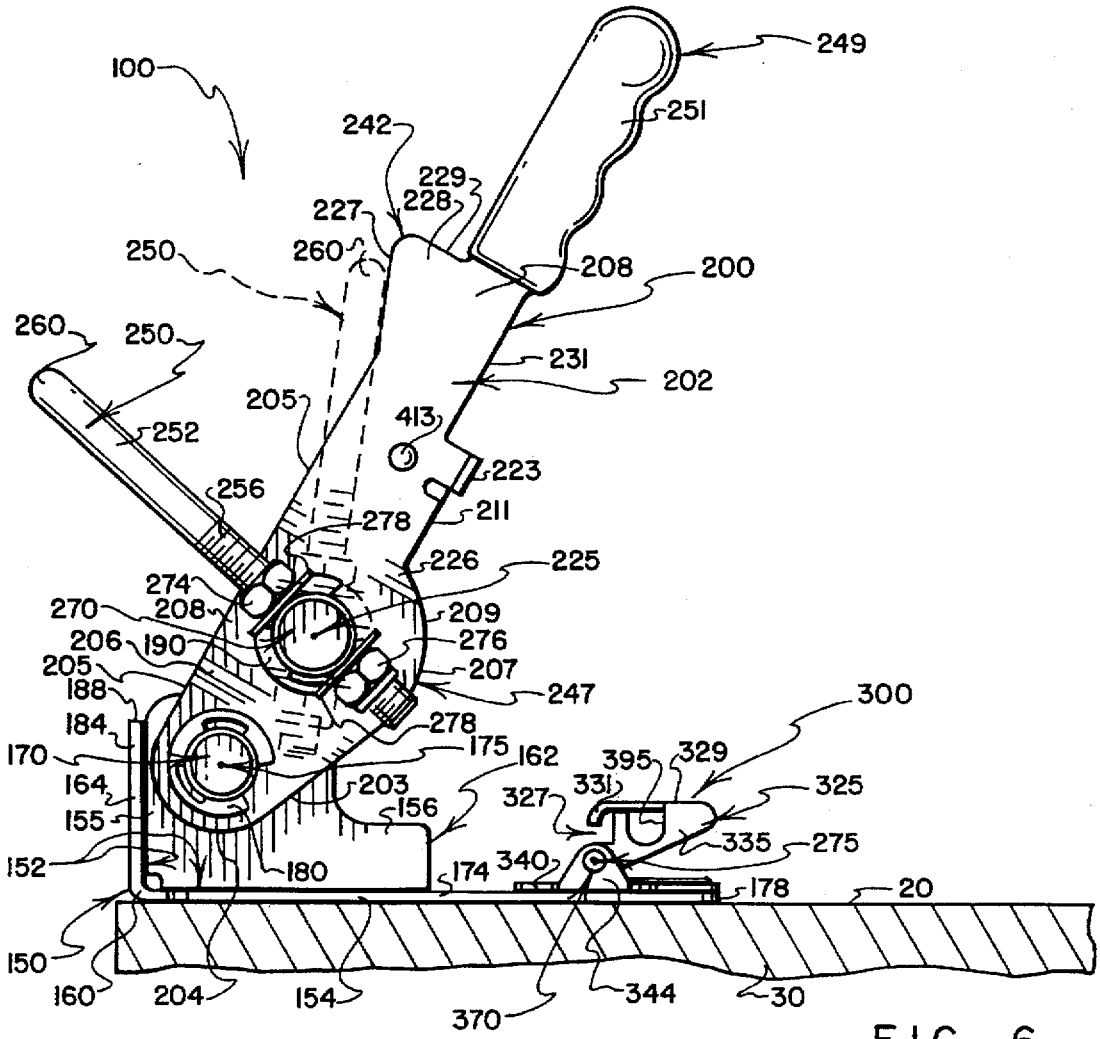
FIG. 6 is a front side elevational view of the mounted latch assembly but with the handle shown pivoted to one of many possible open positions, with the drawbar shown in solid lines as having been pivoted to one of many possible extended positions (and shown in phantom in a retracted position), and with the safety catch shown in its normal, non-operated position.

To move the drawbar 250 into embracing engagement with the latch-engagement formation 50, the safety catch 300 is operated (as is depicted in FIG. 5 to release the engagement of the latching notch 327 with the catch-engagement formation 223), and the handle 200 is pivoted about the first pivot axis 175 from its closed position to the open position shown in FIG. 6, and onward to the open position shown in FIG. 7. As the handle 200 is moved into the open position shown in FIG. 7, the drawbar 250 is pivoted relative to the handle 200 about the second pivot axis 225 to move the drawbar 250 away from its retracted position toward extended positions that are shown in solid lines in FIGS. 6 and 7 to bring the drawbar 250 into embracing engagement with the post-like latch-engagement formation 50, as is depicted in FIG. 7.

With the drawbar 250 embracing the post-like latch-engagement formation 50, the handle 200 is pivoted about the first pivot axis 175 toward its closed position. As the handle 200 approaches its closed position, the catch-engagement formation 223 cams the pivotally mounted catch member 325 in opposition to the action of the leaf spring 380 away from its latched position toward its unlatched position, as is shown in FIG. 8. As the handle 200 reaches its closed position, the biasing action of the leaf spring 380 snaps the pivotally mounted catch member 325 into its latched position to bring its latching notch 327 into retaining engagement with the catch-engagement formation 223 of the handle.

To ensure that the drawbar 250 properly applies force to the latch-engagement formation 50 during closure movement of the handle 200, the lock nuts 274, 284 and 276, 286 may be adjusted along the threaded end regions 256, 266 of the drawbar 250, as needed. The adjustment of the lock nuts 274, 284 and 276, 286 affects the "effective length" of the drawbar 250.

As will be apparent from the foregoing description, the latch 100 provides an especially rugged form of handle operated, toggle type draw latch that will withstand heavy force loads, that self-reinforces its components by providing well designed component interactions when the latch is "latched," and that can perform well during a lengthy service life in difficult conditions of use.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty as exist in the invention.

What is claimed is:

1. In a toggle type draw latch assembly having a base, having an elongate operating handle that is pivotally connected by means of a first pivot pin to the base near one end region of the handle for permitting movement of the handle relative to the base about a first pivot axis of the first pivot pin between a fully open position wherein a portion of the handle is extended relative to the base and a fully closed position wherein the handle portion is situated relatively near to the base, having a hand grip formed near the opposite end region thereof, having a drawbar pivotally connected to the handle at a location that is nearer to the one end region of the handle than to the hand grip, with the drawbar being pivotally movable relative to the handle about a second pivot axis between an extended position and a retracted position wherein a portion of the drawbar is situated relatively near to the hand grip, the improvement comprising:

a) the base being formed as an assembly of a substantially L-shaped member and a substantially U-shaped member;

b) the L-shaped member having a substantially flat mounting leg that is joined by a substantially right angle bend to a substantially flat end leg that has a length measured from the right angle bend that is less than is the length of the mounting leg measured from the right angle bend, with the mounting leg and the end leg each having front and rear portions that are located on opposite sides of a common imaginary center plane that intersects substantially at right angles the mounting leg and the end leg along imaginary center lines that extend substantially centrally with respect to the mounting leg and the end leg, respectively;

c) the U-shaped member having a pair of substantially flat, similarly configured, front and rear legs that are rigidly connected by substantially right angle bends to a substantially flat base leg, with the front and rear legs:

1) being oriented to extend in spaced, substantially parallel relationship so as to overlie each other;

2) having end surfaces that overlie each other and that extend substantially perpendicular to the substantially flat base leg;

3) having aligned holes formed therethrough that are of a size that will closely receive the first pivot pin;

d) first connecting means for rigidly connecting the U-shaped member to the L-shaped member 1) such that the front and rear legs of the U-shaped member are positioned to extend in substantially parallel planes on opposed front and rear sides of, and at substantially equal distances from said imaginary center plane, 2) such that the base leg of the U-shaped member engages a selected one of the mounting leg and the end leg of the L-shaped member, and 3) such that the overlying end surfaces of the front and rear legs of the U-shaped member engage the other of the mounting leg and the end leg of the L-shaped member;

e) the handle being formed as an assembly that includes:

1) a pair of elongate front and rear handle members that extend in overlying relationship from A) overlying first end regions of the front and rear handle members that have aligned holes formed therethrough that are of a size that will closely receive the first pivot pin, and B) overlying second end regions of the front and rear handle members are similarly configured and cooperate to define an elongate handgrip that is always located farther from the first pivot pin than is said portion of the drawbar that is situated relatively near to the hand grip regardless of the orientation of the drawbar relative to the handle; and, 2) stop formation means defined by overlying, similarly configured formations of the front and rear handle members for cooperatively defining a stop that engages a selected one of the mounting leg and the end leg of the L-shaped base member when the handle is in a selected one of its fully open and fully closed positions; and, f) with the handle also defining a drawbar engaging surface 1) that is situated along the length of the handle at a chosen location which is between the first pivot pin and the handgrip, 2) that is configured to be engaged by the drawbar when the drawbar is in its retracted position, and 3) that is configured so as to ensure that, when the drawbar is in engagement with the drawbar engaging surface, the drawbar will be prevented from so closely approaching the handgrip as to come into contact with portions of a hand that is gripping the hand grip.

2. The toggle type draw latch assembly of claim 1 additionally including second connecting means for being interposed between and for rigidly interconnecting overlying portions of the front and rear handle members while maintaining a spaced relationship between the front and rear handle members.

3. The toggle type draw latch assembly of claim 2 wherein the second connecting means includes at least one generally cylindrical spacer having opposed end regions that are of reduced diameter and that are configured 1) to be inserted through aligned apertures formed in said overlying portions of the front and rear handle members, and 2) to be riveted after being inserted through said aligned apertures to thereby rigidly interconnect said overlying portions of the front and rear handle members.

4. The toggle type draw latch assembly of claim 3 wherein said overlying portions of the front and rear handle members include said similarly configured second end regions, at least two of the cylindrical spacers with riveted opposed end regions rigidly interconnect the similarly configured second end regions, a sleeve of heat-shrinkable plastic is shrunk to closely surround and grip said similarly configured second end regions of the front and rear handles such that said at least two spacers also are encompassed by the sleeve to assist in defining the handgrip.

5. The toggle type draw latch assembly of claim 1 wherein the stop formation means includes first and second stop formations that are defined by first and second overlying, similarly configured formations of the front and rear handle members, with the first stop formation being configured to engage the end leg of the L-shaped base member when the handle is in its "fully open" position to define one end of a range of possible pivotal movement of the handle relative to the base, and with the second stop formation being configured to engage the end leg of the L-shaped base member when the handle is in its "fully closed" position to define an opposite end of a range of possible pivotal movement of the handle relative to the base.

6. The toggle type draw latch assembly of claim 1 wherein:

a) the latch assembly additionally includes means for adjusting the effective length of the drawbar within a given range of adjustment, with such adjustment affecting the nearness of the drawbar to the hand grip when the drawbar is in its retracted position; and, b) the drawbar engaging surface extends for a sufficient distance along the length of the handle at said chosen location for being engaged by the drawbar when the drawbar is in its retracted position regardless of where within said given range of adjustment said means for adjusting the effective length of the drawbar is set.

7. The toggle type draw latch assembly of claim 1 additionally including drawbar biasing means for biasing the drawbar to pivot toward its retracted position relative to the handle.

8. The toggle type draw latch assembly of claim 7 wherein 1) the front and rear handle members are spaced apart at a chosen location situated between the location of the handgrip and the location of the aligned holes, 2) aligned circular openings are formed through the spaced front and rear handle members at said chosen location, 3) an elongate second pivot pin extends through and is closely received within the aligned circular openings so as to be pivotally connected to the handle for movement relative to the handle about an imaginary second pivot axis that extends centrally along the length of the second pivot pin, 4) the drawbar is connected to opposite end regions of the second pivot pin for pivotal movement therewith relative to the handle, and 5) said biasing means is interposed between the handle and the second pivot pin for biasing the drawbar relative to the handle toward the retracted position of the drawbar.

9. The toggle type draw latch assembly of claim 8 wherein the biasing means includes a torsion coil spring having at least one coil of spring wire that extends relatively loosely about a central portion of the second pivot pin that extends between the spaced front and rear handle members at said chosen location.

10. In a toggle type draw latch assembly having a base, having an elongate operating handle that is pivotally connected by means of a first pivot pin to the base near one end region of the handle for permitting movement of the handle relative to the base about a first pivot axis of the first pivot pin between a fully open position wherein a portion of the handle is extended relative to the base and a fully closed position wherein the handle portion is situated relatively near to the base, having a hand grip formed near the opposite end region thereof, having a drawbar pivotally connected to the handle at a location that is nearer to the end region of the handle than to the hand grip, with the drawbar being pivotally movable relative to the handle about a second pivot axis between an extended position and a retracted position wherein a portion of the drawbar is situated relatively near to the hand grip, the improvement comprising:

a) the base being formed as an assembly of a substantially L-shaped member and a substantially U-shaped member;

b) the L-shaped member having a substantially flat mounting leg that is joined by a substantially right angle bend to a substantially flat end leg that has a length measured from the right angle bend that is less than is the length of the mounting leg measured from the right angle bend, with the mounting leg and the end leg each having front and rear portions that are located on opposite sides of a common imaginary center plane that intersects substantially at right angles the mounting leg and the end leg along imaginary center lines that extend substantially centrally with respect to the mounting leg and the end leg, respectively;

c) the U-shaped member having a pair of substantially flat, similarly configured, front and rear legs that are rigidly connected by substantially right angle bends to a substantially flat base leg, with the front and rear legs:

1) being oriented to extend in spaced, substantially parallel relationship so as to overlie each other;

2) having end surfaces that overlie each other and that extend substantially perpendicular to the substantially flat base leg;

3) having aligned holes formed therethrough that are of a size that will closely receive the first pivot pin;

d) first connecting means for rigidly connecting the U-shaped member to the L-shaped member 1) such that the front and rear legs of the U-shaped member are positioned to extend in substantially parallel planes on opposed front and rear sides of, and at substantially equal distances from said imaginary center plane, 2) such that the base leg of the U-shaped member engages a selected one of the mounting leg and the end leg of the L-shaped member, and 3) such that the overlying end surfaces of the front and rear legs of the U-shaped member engage the other of the mounting leg and the end leg of the L-shaped member;

e) the handle being formed as an assembly that includes:

1) a pair of elongate front and rear handle members that extend in overlying relationship from A) overlying first end regions of the front and rear handle members that have aligned holes formed therethrough that are of a size that will closely receive the first pivot pin, and B) overlying second end regions of the front and rear handle members are similarly configured and cooperate to define a handgrip; and, 2) stop formation means defined by overlying, similarly configured formations of the front and rear handle members for cooperatively defining a stop that engages a selected one of the mounting leg and the end leg of the L-shaped base member when the handle is in a selected one of its fully open and fully closed positions;

f) means for adjusting the effective length of the drawbar within a given range of adjustment, with such adjustment affecting the nearness of the drawbar to the hand grip when the drawbar is in its retracted position;

g) auxiliary stop formation means for defining drawbar engaging surface means at a location near the hand grip for being engaged by the drawbar when the drawbar is in its retracted position, with the auxiliary stop formation means also being connected to the handle;

h) with the drawbar engaging surface means including a surface that extends for a sufficient distance along the length of the handle at said location near the hand grip for being engaged by the drawbar when the drawbar is in its retracted position regardless of where within said given range of adjustment the means for adjusting the effective length of the drawbar is set; and, i) with the drawbar engaging surface being configured to ensure that the retracted position of the drawbar is held at a sufficiently far distance away from the location of the hand grip to ensure that, regardless of where within said given range of adjustment the means for adjusting the effective length of the drawbar is set, the retracted drawbar will not so closely approach the hand grip as to endanger portions of a hand that is gripping the hand grip being contacted by the retracted drawbar.

11. The toggle type draw latch assembly of claim 10 wherein the hand grip extends about an imaginary centerline that generally parallels the length of the elongate handle so as to extend through said one and opposite end regions of the handle, and the drawbar engaging surface is configured to extend progressively farther from said centerline the closer that it approaches the hand grip.

12. The toggle type draw latch assembly of claim 11 wherein the drawbar engaging surface is planar in character in that it extends substantially within a common plane that is inclined relative to said centerline so as to more closely approach the centerline as it extends away from the hand grip.

13. In a toggle type draw latch assembly having a base, having an elongate operating handle that is pivotally connected by means of a first pivot pin to the base near one end region of the handle for permitting movement of the handle relative to the base about a first pivot axis of the first pivot pin between a fully open position wherein a portion of the handle is extended relative to the base and a fully closed position wherein the handle portion is situated relatively near to the base, having a hand grip formed near the opposite end region thereof, having a drawbar pivotally connected to the handle at a location that is nearer to the one end region of the handle than to the hand grip, with the drawbar being pivotally movable relative to the handle about a second pivot axis between an extended position and a retracted position wherein a portion of the drawbar is situated relatively near to the hand grip, the improvement comprising:

a) the base being formed as an assembly of a substantially L-shaped member and a substantially U-shaped member;

b) the L-shaped member having a substantially flat mounting leg that is joined by a substantially right angle bend to a substantially flat end leg that has a length measured from the right angle bend that is less than is the length of the mounting leg measured from the right angle bend, with the mounting leg and the end leg each having front and rear portions that are located on opposite sides of a common imaginary center plane that intersects substantially at right angles the mounting leg and the end leg along imaginary center lines that extend substantially centrally with respect to the mounting leg and the end leg, respectively;

c) the U-shaped member having a pair of substantially flat, similarly configured, front and rear legs that are rigidly connected by substantially right angle bends to a substantially flat base leg, with the front and rear legs:
1) being oriented to extend in spaced, substantially parallel relationship so as to overlie each other;
2) having end surfaces that overlie each other and that extend substantially perpendicular to the substantially flat base leg;
3) having aligned holes formed therethrough that are of a size that will closely receive the first pivot pin;

d) first connecting means for rigidly connecting the U-shaped member to the L-shaped member 1) such that the front and rear legs of the U-shaped member are positioned to extend in substantially parallel planes on opposed front and rear sides of, and at substantially equal distances from said imaginary center plane, 2) such that the base leg of the U-shaped member engages a selected one of the mounting leg and the end leg of the L-shaped member, and 3) such that the overlying end surfaces of the front and rear legs of the U-shaped member engage the other of the mounting leg and the end leg of the L-shaped member;

e) the handle being formed as an assembly that includes:
1) a pair of elongate front and rear handle members that extend in overlying relationship from A) overlying first end regions of the front and rear handle members that have aligned holes formed therethrough that are of a size that will closely receive the first pivot pin, and B) overlying second end regions of the front and rear handle members are similarly configured and cooperate to define a handgrip; and,
2) stop formation means defined by overlying, similarly configured formations of the front and rear handle members for cooperatively defining a stop that engages a selected one of the mounting leg and the end leg of the L-shaped base member when the handle is in a selected one of its fully open and fully closed positions;

f) drawbar biasing means for biasing the drawbar to pivot toward its retracted position relative to the handle;

g) wherein 1) the front and rear handle members are spaced apart at a chosen location situated between the location of the handgrip and the location of the aligned holes, 2) aligned circular openings are formed through the spaced front and rear handle members at said chosen location, 3) an elongate second pivot pin extends through and is closely received within the aligned circular openings so as to be pivotally connected to the handle for movement relative to the handle about an imaginary second pivot axis that extends centrally along the length of the second pivot pin, 4) the drawbar is connected to opposite end regions of the second pivot pin for pivotal movement therewith relative to the handle, and 5) said biasing means is interposed between the handle and the second pivot pin for biasing the drawbar relative to the handle toward the retracted position of the drawbar; and, h) wherein the front and rear legs of the U-shaped base member define congruently extending concave curves that closely receive the second pivot pin when the handle is "fully closed" to assist in maintaining the second pivot pin in a desired position.

14. In a toggle type draw latch assembly having a base, having an elongate operating handle that is pivotally connected by means of a first pivot pin to the base near one end region of the handle for permitting movement of the handle relative to the base about a first pivot axis of the first pivot pin between a fully open position wherein a portion of the handle is extended relative to the base and a fully closed position wherein the handle portion is situated relatively near to the base, having a hand grip formed near the opposite end region thereof, having a drawbar pivotally connected to the handle at a location that is nearer to the one end region of the handle than to the hand grip, with the drawbar being pivotally movable relative to the handle about a second pivot axis between an extended position and a retracted position wherein a portion of the drawbar is situated relatively near to the hand grip, the improvement comprising:

a) the base being formed as an assembly of a substantially L-shaped member and a substantially U-shaped member;

b) the L-shaped member having a substantially flat mounting leg that is joined by a substantially right angle bend to a substantially flat end leg that has a length measured from the right angle bend that is less than is the length of the mounting leg measured from the right angle bend, with the mounting leg and the end leg each having front and rear portions that are located on opposite sides of a common imaginary center plane that intersects substantially at right angles the mounting leg and the end leg along imaginary center lines that extend substantially centrally with respect to the mounting leg and the end leg, respectively;

c) the U-shaped member having a pair of substantially flat, similarly configured, front and rear legs that are rigidly connected by substantially right angle bends to a substantially flat base leg, with the front and rear legs:
1) being oriented to extend in spaced, substantially parallel relationship so as to overlie each other;
2) having end surfaces that overlie each other and that extend substantially perpendicular to the substantially flat base leg;
3) having aligned holes formed therethrough that are of a size that will closely receive the first pivot pin;

d) first connecting means for rigidly connecting the U-shaped member to the L-shaped member 1) such that the front and rear legs of the U-shaped member are positioned to extend in substantially parallel planes on opposed front and rear sides of, and at substantially equal distances from said imaginary center plane, 2) such that the base leg of the U-shaped member engages a selected one of the mounting leg and the end leg of the L-shaped member, and 3) such that the overlying end surfaces of the front and rear legs of the U-shaped member engage the other of the mounting leg and the end leg of the L-shaped member;

e) the handle being formed as an assembly that includes:

1) a pair of elongate front and rear handle members that extend in overlying relationship from A) overlying first end regions of the front and rear handle members that have aligned holes formed therethrough that are of a size that will closely receive the first pivot pin, and B) overlying second end regions of the front and rear handle members are similarly configured and cooperate to define a handgrip; and, 2) stop formation means defined by overlying, similarly configured formations of the front and rear handle members for cooperatively defining a stop that engages a selected one of the mounting leg and the end leg of the L-shaped base member when the handle is in a selected one of its fully open and fully closed positions;

f) safety catch means for being movably connected to the base for extending adjacent the handle when the handle is in its closed position, and for being connected to the base at a location that positions the safety catch means beside a selected portion of the handle that is located between said one and opposite end regions when the handle is in its closed position; and, g) a safety catch engagement formation connected to the handle and being movable therewith as the handle pivots relative to the base between said open and closed positions, with the safety catch engagement formation being configured to engage and to be releasably retained by the safety catch means when the handle is in its closed position.

15. The toggle type draw latch assembly of claim 14 wherein the safety catch means includes a catch member that is pivotally connected to the base for movement between latched and unlatched positions, includes biasing means for biasing the catch member toward its latched position, is operable to engage and releasably retain the safety catch engagement formation when the handle is in its closed position and the catch member is in its latched position, and is configured such that, as the handle moves toward its closed position, the catch member is engaged by the safety catch engagement formation and is caused by such engagement to be cammed away from its latched position in opposition to the biasing action of the biasing means to permit the safety catch engagement formation to move into engaged, releasably retained relationship with the catch member when the handle reaches its closed position.

16. The toggle type draw latch assembly of claim 15 wherein the safety catch means defines first shackle engagement formation means for receiving the shackle of a padlock when the catch member is in its latched position, with the received shackle physically blocking movement of the catch member from its latched position to its unlatched position.

17. In a toggle type draw latch assembly that has a base, an elongate operating handle that is pivotally connected to the base near one end region thereof by means of a first pivot pin that extends through first aligned holes formed through the handle, with the handle being movable between an open position and a closed position wherein a portion of the handle is situated relatively near to the base, having a hand grip formed near the opposite end region thereof, having a drawbar pivotally connected to the handle at a location that is nearer to the one end region of the handle than to the hand grip by means of a second pivot pin that extends through second aligned holes formed through the handle, with the drawbar being connected to the second pivot pin and being movable about the axis of the second pivot pin relative to the handle between an extended position and a retracted position for engaging a latch-engageable formation to establish a connection between the latch assembly and the latch-engageable formation, the improvement comprising:

a) safety catch means for being movably connected to the base for extending adjacent the handle when the handle is in its closed position, and for being connected to the base at a location that positions the safety catch means beside a selected portion of the handle that is located between said one and opposite end regions when the handle is in its closed position;

b) a safety catch engagement formation connected to the handle and being movable therewith as the handle pivots relative to the base between said open and closed positions, with the safety catch engagement formation being configured to engage and to be releasably retained by the safety catch means when the handle is in its closed position;

c) wherein the safety catch means 1) includes a catch member that is pivotally connected to the base for movement between latched and unlatched positions, 2) includes biasing means for biasing the catch member toward its latched position, 3) is operable to engage and releasably retain the safety catch engagement formation when the handle is in its closed position and the catch member is in its latched position, and 4) is configured such that, as the handle moves toward its closed position, the catch member is engaged by the safety catch engagement formation and is caused by such engagement to be cammed away from its latched position in opposition to the biasing action of the biasing means to permit the safety catch engagement formation to move into engaged, releasably retained relationship with the catch member when the handle reaches its closed position;

d) with the safety catch means also defining first shackle engagement formation means for receiving the shackle of a padlock when the catch member is in its latched position, with the received shackle physically blocking movement of the catch member from its latched position to its unlatched position;

e) the handle being formed as an assembly that includes a pair of elongate front and rear handle members that extend in overlying relationship from A) overlying first end regions of the front and rear handle members that have aligned holes formed therethrough that are of a size that will closely receive the first pivot pin, and B) overlying second end regions of the front and rear handle members are similarly configured and cooperate to define a handgrip; and, f) first connecting means for being interposed between and for rigidly interconnecting overlying portions of the front and rear handle members while maintaining a spaced relationship between the front and rear handle members.

18. The toggle type draw latch assembly of claim 17 additionally including stop formation means defined by overlying, similarly configured formations of the front and rear handle members for cooperatively defining a stop that engages the base when the handle is in a selected one of its open and closed positions.

19. The toggle type draw latch assembly of claim 17 additionally including stop formation means defined by overlying, similarly configured formations of the front and rear handle members for cooperatively defining a first stop for engaging one part of the base when the handle is in its closed position, and a second stop for engaging another part of the base when the handle is in its open position.

20. The toggle type draw latch assembly of claim 17 wherein:

a) the base is formed as a welded assembly of a substantially L-shaped member and a substantially U-shaped member;

b) the L-shaped member has a substantially flat mounting leg that is joined by a substantially right angle bend to a substantially flat end leg that has a length measured from the right angle bend that is less than is the length of the mounting leg measured from the right angle bend, with the mounting leg and the end leg each having front and rear portions that are located on opposite sides of a common imaginary center plane that intersects substantially at right angles the mounting leg and the end leg along imaginary center lines that extend substantially centrally with respect to the mounting leg and the end leg, respectively; and, c) the U-shaped member has a pair of substantially flat, similarly configured, front and rear legs that are rigidly connected by substantially right angle bends to a substantially flat base leg, with the front and rear legs:

1) being oriented to extend in spaced, substantially parallel relationship so as to overlie each other;

2) having end surfaces that overlie each other and that extend substantially perpendicular to the substantially flat base leg;

3) having aligned holes formed therethrough that are of a size that will closely receive the first pivot pin; and, d) weld means is provided for rigidly connecting the U-shaped member to the L-shaped member 1) such that the front and rear legs of the U-shaped member are positioned to extend in substantially parallel planes on opposed front and rear sides of, and at substantially equal distances from said imaginary center plane, 2) such that the base leg of the U-shaped member engages and is welded to the L-shaped member, and 3) such that the overlying end surfaces of the front and rear legs of the U-shaped member engage and are welded to end leg of the L-shaped member.

21. The toggle type draw latch assembly of claim 20 wherein the front and rear legs of the U-shaped base member define congruently extending concave curves that closely receive the second pivot pin when the handle is closed to assist in maintaining the second pivot pin in a desired position.

22. The toggle type draw latch assembly of claim 17 wherein the first connecting means includes at least one generally cylindrical spacer member having opposed end regions that are of reduced diameter and that are configured 1) to be inserted through aligned apertures formed in said overlying portions of the front and rear handle members, and 2) to be riveted after being inserted through said aligned apertures to thereby rigidly interconnect said overlying portions of the front and rear handle members.

23. The toggle type draw latch assembly of claim 22 wherein said overlying portions of the front and rear handle members include said similarly configured second end regions, at least two of the cylindrical spacer members with riveted opposed end regions rigidly interconnect the similarly configured second end regions, a sleeve of heat-shrinkable plastic is shrunk to closely surround and grip said similarly configured second end regions of the front and rear handles such that said at least two spacer members also are encompassed by the sleeve to assist in defining said hand-grip.

24. The toggle type draw latch assembly of claim 17 additionally including:

a) means for adjusting the effective length of the drawbar within a given range of adjustment, with such adjustment affecting the nearness of the drawbar to the hand grip when the drawbar is in its retracted position;

b) auxiliary stop formation means for defining drawbar engaging surface means at a location near the hand grip for being engaged by the drawbar when the drawbar is in its retracted position, with the auxiliary stop formation means being connected to the handle;

c) with the drawbar engaging surface means including a surface that extends for a sufficient distance along the length of the handle at said location near the hand grip for being engaged by the drawbar when the drawbar is in its retracted position regardless of where within said given range of adjustment the means for adjusting the effective length of the drawbar is set; and, d) with the drawbar engaging surface being configured to ensure that the retracted position of the drawbar is held at a sufficiently far distance away from the location of the hand grip to ensure that, regardless of where within said given range of adjustment the means for adjusting the effective length of the drawbar is set, the retracted drawbar will not so closely approach the hand grip as to endanger portions of a hand that is gripping the hand grip being contacted by the retracted drawbar.

25. The toggle type draw latch assembly of claim 24 wherein the hand grip extends about an imaginary centerline that generally parallels the length of the elongate handle so as to extend through said one and opposite end regions of the handle, and the drawbar engaging surface is configured to extend progressively farther from said centerline the closer that it approaches the hand grip.

26. The toggle type draw latch assembly of claim 25 wherein the drawbar engaging surface is planar in character in that it extends substantially within a common plane that is inclined relative to said centerline so as to more closely approach the centerline as it extends away from the hand grip.

27. The toggle type draw latch assembly of claim 17 additionally including drawbar biasing means for biasing the drawbar to pivot toward its retracted position relative to the handle.

28. The toggle type draw latch assembly of claim 27 wherein the biasing means includes a torsion coil spring having at least one coil of spring wire that extends relatively loosely about a central portion of the second pivot pin that extends between the spaced front and rear handle members at said chosen location.

29. The toggle type draw latch assembly of claim 28 wherein:

a) a radially extending hole is formed in said central portion of the second pivot pin, with the radially extending hole being located substantially mid-way between the front and rear handle members;

b) an elongate pin member has one portion that is pressed into the radially extending hole, and another portion that projects radially outwardly from the radially extending hole; and, c) the torsion coil spring has:

1) first and second end regions that are connected to the handle;

2) a central region that is connected to said another portion of said elongate pin member near where said elongate pin member emerges from said radially extending hole;

3) a first set of coils that is formed integrally with said first end region and with said central region, and that are reeved loosely about the central portion of the second pivot pin at a location between the front handle member and the location where the elongate pin member emerges from said radially extending hole; and, 4) a second set of soils that is formed integrally with said second end region and with said central region, and that are reeved loosely about the central portion of the second pivot pin at a location between the rear handle member and the location where the elongate pin member emerges from said radially extending hole.

30. A handle operated toggle-type draw latch assembly for mounting on one of two members for engaging a latch-engageable formation connected to the other of the two members for exerting force on the two members that tends to draw the two members relatively toward each other and for releasably retaining the two members in joined relationship, comprising:

a) base means for being connected to a mounting surface of said one of two members that are to be joined and releasably retained in joined relationship, for defining spaced, parallel extending front and rear members, for defining a safety catch mount that extends away from the mounting surface at a location spaced along the mounting surface from the location of the handle mounting means, with a first imaginary pivot axis being defined by one set of aligned holes formed through the front and rear members, and with a third imaginary pivot axis being defined by the safety catch mount;

b) first pivot pin means extending through and being closely received by the one set of aligned holes formed through the front and rear members and extending along the first pivot axis;

c) handle means including an elongate handle that is formed by elongate front and rear handle members that are similarly configured so as to define corresponding formations that overlie each other but that are held in spaced relationship by mounting means that rigidly connects the front and rear handle members, with the corresponding formations that overlie each other including 1) first end regions that define a first set of aligned holes formed therethrough that closely receive the first pivot pin means to pivotally connect the elongate handle to the base means, 2) second end regions that cooperate to define overlying handgrip formations, 3) first, second and third sets of overlying formations that cooperate to define first, second and third stops located at spaced positions along the length of the handle between the first and second end regions, and 4) a second set of aligned holes formed through the front and rear handle members for defining a second pivot axis that extends transversely relative to the length of the handle in a direction that substantially parallels the first pivot axis but is spaced along the length of the handle from the first pivot axis, and with the pivotal connection of the handle means and the base means being operative to permit movement of the handle means relative to the base means about the first pivot axis in a closing direction of movement toward a closed position wherein the first stop formation engages the base means to prevent further relative movement of the handle in said closing direction of movement, and in an opening direction of movement that extends opposite the closing direction of movement toward an open position wherein the second stop formation engages the base means to prevent further relative movement of the handle in said opening direction of movement;

d) second pivot pin means connected to the handle and being configured to extend generally along the second pivot axis;

e) drawbar means including an elongate drawbar for being connected to the second pivot pin means for pivotal movement relative to the handle for selectively being brought into engagement with the latch-engageable formation when the handle is pivoted to its open position, and for transmitting force to and establishing a joining connection with the latch-engageable formation when the handle is moved to its closed position while the drawbar means is engaging the latch-engageable formation, and for being pivoted to a retracted position wherein the drawbar engages the third stop formation of the handle;

f) third pivot pin means connected to the safety catch mount at the second location along the base means and being configured to extend along the third pivot axis; and, g) safety catch means including a safety catch member for being pivotally connected by the third pivot pin means to the base means for pivotal movement relative to the base means about the third pivot axis between latched and unlatched positions, for defining a safety catch formation engagement means for receiving and releasably retaining a handle-carried catch engaging formation when the handle is pivoted to its closed position and when the safety catch is pivoted to its latched position, and including biasing means interposed between the base means and the safety catch member for biasing the safety catch member away from its unlatched position toward its latched position.

31. In a toggle type draw latch assembly having a base, having an elongate operating handle that is pivotally connected by means of a first pivot pin to the base near one end region of the handle for permitting movement of the handle relative to the base about a first pivot axis of the first pivot pin between a fully open position wherein a portion of the handle is extended relative to the base and a fully closed position wherein the handle portion is situated relatively near to the base, having a hand grip formed near the opposite end region thereof, having a drawbar pivotally connected to the handle at a location that is nearer to the one end region of the handle than to the hand grip, with the drawbar being pivotally movable relative to the handle about a second pivot axis between an extended position and a retracted position wherein a portion of the drawbar is situated relatively near to the hand grip, the improvement comprising:

a) the base being formed as an assembly of a substantially L-shaped member and a substantially U-shaped member;

b) the L-shaped member having a substantially flat mounting leg that is joined by a substantially right angle bend to a substantially flat end leg that has a length measured from the right angle bend that is less than is the length of the mounting leg measured from the right angle bend, with the mounting leg and the end leg each having front and rear portions that are located on opposite sides of a common imaginary center plane that intersects substantially at right angles the mounting leg and the end leg along imaginary center lines that extend substantially centrally with respect to the mounting leg and the end leg, respectively;

c) the U-shaped member having a pair of substantially flat, similarly configured, front and rear legs that are rigidly connected by substantially right angle bends to a substantially flat base leg, with the front and rear legs:
1) being oriented to extend in spaced, substantially parallel relationship so as to overlie each other;
2) having end surfaces that overlie each other and that extend substantially perpendicular to the substantially flat base leg;
3) having aligned holes formed therethrough that are of a size that will closely receive the first pivot pin;

d) first connecting means for rigidly connecting the U-shaped member to the L-shaped member 1) such that the front and rear legs of the U-shaped member are positioned to extend in substantially parallel planes on opposed front and rear sides of, and at substantially equal distances from said imaginary center plane, 2) such that the base leg of the U-shaped member engages a selected one of the mounting leg and the end leg of the L-shaped member, and 3) such that the overlying end surfaces of the front and rear legs of the U-shaped member engage the other of the mounting leg and the end leg of the L-shaped member;

e) the handle being formed as an assembly that includes:
1) a pair of elongate front and rear handle members that extend in overlying relationship from A) overlying first end regions of the front and rear handle members that have aligned holes formed therethrough that are of a size that will closely receive the first pivot pin, and B) overlying second end regions of the front and rear handle members are similarly configured and cooperate to define a handgrip; and,
2) stop formation means defined by overlying, similarly configured formations of the front and rear handle members for cooperatively defining a stop that engages a selected one of the mounting leg and the end leg of the L-shaped base member when the handle is in a selected one of its fully open and fully closed positions;

f) drawbar biasing means for biasing the drawbar to pivot toward its retracted position relative to the handle;

g) wherein 1) the front and rear handle members are spaced apart at a chosen location situated between the location of the handgrip and the location of the aligned holes, 2) aligned circular openings are formed through the spaced front and rear handle members at said chosen location, 3) an elongate second pivot pin extends through and is closely received within the aligned circular openings so as to be pivotally connected to the handle for movement relative to the handle about an imaginary second pivot axis that extends centrally along the length of the second pivot pin, 4) the drawbar is connected to opposite end regions of the second pivot pin for pivotal movement therewith relative to the handle, and 5) said biasing means is interposed between the handle and the second pivot pin for biasing the drawbar relative to the handle toward the retracted position of the drawbar;

h) wherein the biasing means includes a torsion coil spring having at least one coil of spring wire that extends relatively loosely about a central portion of the second pivot pin that extends between the spaced front and rear handle members at said chosen location;

i) wherein a radially extending hole is formed in said central portion of the second pivot pin, with the radially extending hole being located substantially mid-way between the front and rear handle members;

j) wherein an elongate pin member has one portion that is pressed into the radially extending hole, and another portion that projects radially outwardly from the radially extending hole; and, k) wherein the torsion coil spring has:
1) first and second end regions that are connected to the handle;
2) a central region that is connected to said another portion of said elongate pin member near where said elongate pin member emerges from said radially extending hole;
3) a first set of coils that is formed integrally with said first end region and with said central region, and that are reeved loosely about the central portion of the second pivot pin at a location between the front handle member and the location where the elongate pin member emerges from said radially extending hole; and,
4) a second set of coils that is formed integrally with said second end region and with said central region, and that are reeved loosely about the central portion of the second pivot pin at a location between the rear handle member and the location where the elongate pin member emerges from said radially extending hole.

* * * * *